US010227752B2

(12) United States Patent
Naud et al.

(10) Patent No.: US 10,227,752 B2
(45) Date of Patent: Mar. 12, 2019

(54) AERO-EXCAVATION APPARATUS AND METHOD OF OPERATING THE SAME

(71) Applicant: GENIX DÉVELOPPEMENT, Ville d'Anjou (CA)

(72) Inventors: Jean-Luc Naud, Lanoraie (CA); Mathieu Bouchard, L'Assomption (CA)

(73) Assignee: GÉNIX DÉVELOPPEMENT, Joliette (CA)

( * ) Notice: Subject to any disclaimer, the term of this patent is extended or adjusted under 35 U.S.C. 154(b) by 219 days.

(21) Appl. No.: 15/028,753

(22) PCT Filed: Nov. 6, 2014

(86) PCT No.: PCT/CA2014/000799
§ 371 (c)(1),
(2) Date: Apr. 12, 2016

(87) PCT Pub. No.: WO2015/066798
PCT Pub. Date: May 14, 2015

(65) Prior Publication Data

US 2016/0244941 A1 Aug. 25, 2016

Related U.S. Application Data

(60) Provisional application No. 61/900,724, filed on Nov. 6, 2013.

(51) Int. Cl.
*E02F 3/92* (2006.01)
*E02F 3/90* (2006.01)
(Continued)

(52) U.S. Cl.
CPC ..... *E02F 3/925* (2013.01); *E02F 3/8816* (2013.01); *E02F 3/8891* (2013.01); *E02F 3/90* (2013.01); *E02F 7/04* (2013.01); *E02F 7/06* (2013.01)

(58) Field of Classification Search
CPC ..... E02F 3/925; E02F 3/8816; E02F 3/8891; E02F 3/90; E02F 7/04; E02F 7/06
See application file for complete search history.

(56) References Cited

U.S. PATENT DOCUMENTS 1,886,069 A * 11/1932 Wandscheer ..... E01H 5/098 37/270
4,364,434 A * 12/1982 Erholm ..... A01B 43/00 171/63

(Continued)

FOREIGN PATENT DOCUMENTS

| | | |
|---|---|---|
| GB | 201301713 | 3/2013 |
| JP | S58222225 | 12/1983 |
| WO | WO 02095144 | 11/2002 |

OTHER PUBLICATIONS

Supplementary Partial European Search Report (ESR)—EP 14 86 0571 (EPO Form 1506 03.82)—May 31, 2017—17 pages, Pedersen, Henrik.
International Search Report PCT/CA2014/000799.

*Primary Examiner* — Jamie L McGowan
(74) *Attorney, Agent, or Firm* — Benoit & Cote, Inc.; C. Marc Benoit

(57) ABSTRACT

An aero-excavation apparatus for collecting a fractured soil material using a vacuum hose, the apparatus comprising: a main frame; a motor mounted on the main frame; a traction and direction system in driving arrangement with the motor for driving and operating the main frame; and a blower in driving engagement with the motor; wherein the blower is in fluid communication with the vacuum hose for collecting the fractured soil material.

20 Claims, 22 Drawing Sheets

(51) Int. Cl.

| | |
|---|---|
| ***E02F 3/88*** | (2006.01) |
| ***E02F 7/04*** | (2006.01) |
| ***E02F 7/06*** | (2006.01) |

(56) References Cited

U.S. PATENT DOCUMENTS

| | | | | |
|---|---|---|---|---|
| 4,574,420 | A | 3/1986 | Dupre | |
| 5,241,764 | A * | 9/1993 | Modig | E02F 3/407 37/405 |
| 5,487,229 | A * | 1/1996 | Nathenson | E02F 3/925 175/67 |
| 5,860,232 | A | 1/1999 | Nathenson | |
| 6,202,330 | B1 | 3/2001 | Bolton | |
| 6,408,551 | B1 * | 6/2002 | Pettersson | B07B 1/12 37/409 |
| 7,059,072 | B2 * | 6/2006 | Archuleta, Jr. | E02F 3/40 299/26 |
| 7,086,184 | B2 * | 8/2006 | Archuleta, Jr. | E02F 3/40 37/404 |
| 9,345,373 | B2 * | 5/2016 | Betton | A47L 11/34 |
| 2008/0083413 | A1 | 4/2008 | Maybury | |
| 2009/0064544 | A1 * | 3/2009 | Rajewski | E02F 3/88 37/403 |
| 2010/0095559 | A1 | 4/2010 | Buckner | |
| 2010/0098520 | A1 * | 4/2010 | Barone | E02F 3/8825 414/680 |
| 2011/0107548 | A1 | 5/2011 | Maybury | |
| 2017/0370071 | A1 * | 12/2017 | Buckner | E02F 3/905 |

* cited by examiner

AERO-EXCAVATION APPARATUS AND METHOD OF OPERATING THE SAME

CROSS-REFERENCE TO RELATED APPLICATIONS

This application claims priority of U.S. provisional patent application No. 61/900,724 filed on Nov. 6, 2014.

FIELD

The subject matter disclosed generally relates to excavation apparatus and to methods of operating the same. More particularly, the subject matter disclosed relates to aero-excavation apparatus of the type which employs air to fracture/break soil and a vacuum to remove the fractured/broke soil and methods of operating the same.

BACKGROUND

The concept of vacuum excavation is well known. Many documents disclose soil excavation systems in which a jet of air is directed against a mass of soil by a hand-held nozzle to cause the mass to break up, and in which the loosened soil is collected by entraining it in an air flow carried by a pipe or conduit, and depositing the entrained soil at a site away from the excavation site.

Additionally, the theory underlying the concept of vacuum excavation is well-known. Indeed, application of supersonic or high pressured jets of air causes local fracturing of the soil and rapid release of expanding high pressure air trapped within the soil at the local fracture sites. The fracturing and gas-release properties of the soil are not shared by man-made structures buried within the soil, such as natural gas lines, water pipes, sewer lines, electric cables, fiber optic and the like, and thus these structures are unaffected by the supersonic or high pressured air jets. It is to be noted that many accidents/explosions have occurred when workers were trying to mechanically dig near natural gas lines.

Loosening of the soil by local fracturing and rapid expansion of gases trapped in the soil rather than by direct impact means that the air delivery device generates relatively low reaction forces and are often manipulated by a single person. Vacuum excavation therefore increases productivity relative to hand-excavation methods, such as, without limitation, shovels, without sacrificing precision, significantly reducing visible alteration of local landscaping or paving. In addition, the use of a high vacuum for material collection causes an effective evacuation of solid material from difficult to reach areas such as beneath or behind pipes, where shovels cannot fit or are difficult to maneuver. Large truck mounted aero-excavators are widely used.

Despite these advantages, however, the conventional vacuum excavation systems have a number of disadvantages that have prevented their widespread use. Using such conventional vacuum excavation systems may lead to inaccurate work. They can also be used only in limited workspaces and may not be allowed in hard to reach locations.

Firstly, conventional vacuum excavation systems usually include dependent vacuum systems and soil breaking systems, which renders the device inefficient as the vacuum systems and the soil breaking systems cannot be operated efficiently at the same time. Also, the conventional vacuum systems now on the market are most of the time heavy, over dimensioned, difficult to managed by one single worker and difficult to displace in areas where the dimensions are a restriction (i.e., in a backyard, in a garage, and the like). Venturi based systems don't allow soil breaking and vacuum at the same time or require two air compressors. On the other hand, large systems (i.e., Vacmasters) include air compressor and vacuum at the same time.

Secondly, conventional vacuum excavation systems usually come on a trailer or are mounted on motorized 4-wheel drive chassis for allowing the worker/driver to maneuver it while walking behind it (i.e., some are propelled like a snow blower). Mainly, they come as dump truck sized custom build on trailers. This configuration of the systems renders the work harder for the workers when on the excavation sites.

Thirdly, usually, the soil breaking systems integrate a venturi and a compressor, which renders the system very heavy.

There is therefore a need for improved excavation devices for fracturing and removing soil material and for improved methods of operating excavation devices for fracturing and removing soil material.

SUMMARY

According to an embodiment, there is provided an aero-excavation apparatus for collecting a fractured soil material using a vacuum hose. The apparatus comprising: a main frame; a motor mounted on the main frame; a traction and direction system in driving arrangement with the motor for driving and operating the main frame; and a blower in driving engagement with the motor; wherein the blower is in fluid communication with the vacuum hose for collecting the fractured soil material.

According to another embodiment, the apparatus further comprises a container which is either mounted on or about the main frame, and is fluidly connected to the blower and the vacuum hose for receiving the fractured soil material.

According to a further embodiment, the apparatus comprises a transmission operatively coupled to the motor and a pump operatively coupled to the motor.

According to yet another embodiment, the apparatus further comprises another motor operatively coupled to the transmission and the blower.

According to another embodiment, the transmission comprises one of: a mechanical transmission comprising a gear box; a mechanical transmission comprising a centrifugal clutch and a continuously variable transmission; and a hydraulic transmission.

According to a further embodiment, the apparatus further comprises a lifting mechanism mounted on the main frame when the container is mounted on the main frame, the lifting mechanism being in driving arrangement with the motor for displacing the container relative to the main frame between a first position and a second position.

According to yet another embodiment, the container comprises a container opening, the apparatus further comprising a container trap for closing the container opening, the container trap being in driving arrangement with the motor for allowing the container trap to move between a closed position and an opened position.

According to another embodiment, the apparatus further comprises another pump operatively coupled to the pump when the transmission is the hydraulic transmission, the pump being a hydraulic pump, the other pump being another hydraulic pump, the other motor being a hydraulic motor and the blower being a regenerative blower.

According to a further embodiment, the container comprises: a tank; a filter guard container received in the tank;

a filter received in the filter guard container for filtering the collected fractured soil material.

According to yet another embodiment, the container trap comprises: a main section having a edge for covering the container opening; and a hinge mounted on an exterior wall of the container for pivotably connecting with the edge of the main section.

According to another embodiment, the apparatus further comprises a material removal device mounted on the container wherein the collected fractured soil material to exit the container opening when the container trap is in the opened position.

According to a further embodiment, the material removal device comprises: a vibration plate defining a concave surface facing an interior peripheral wall of the container; and an elongated hollow member extending from the concave surface towards to and away from the interior peripheral wall, the elongated hollow member defining a first end and a second end; wherein the first end of the elongated hollow member is adapted to receive compressed fluid, thereby providing the compressed fluid first towards the second end of the elongated hollow member and second towards the concave surface in a way to provide the vibration plate to vibrate and provide the compressed fluid to circulate within the collected fractured material contained in the container.

According to yet another embodiment, the material removal device comprises a raking device, the raking device being configured for movement between an extended position for receiving the collected fractured soil material in the container and a retracted position for raking the collected fractured soil material outside the container opening.

According to another embodiment, the apparatus further comprises the vacuum hose and the vacuum hose comprises a hose section and a nozzle section extending from the hose section.

According to a further embodiment, the apparatus further comprises a driving area within the main frame for allowing a driver to drive and operate the main frame.

According to yet another embodiment, the apparatus further comprises a control system for controlling at least one of: the motor, the traction and direction system and the blower.

According to another embodiment, when a first container is mounted on the main frame the apparatus further comprises a second container about the main frame, the second container being fluidly connected to the blower and the vacuum hose for receiving the fractured soil material.

According to another embodiment, there is provided an aero-excavation apparatus for collecting a fractured soil material, the apparatus comprising: a main frame; a motor mounted on the main frame; a traction and direction system in driving arrangement with the motor for driving and operating the main frame; a blower in driving engagement with the motor; a vacuum hose in fluid communication with the blower for collecting the fractured soil material; and a container mounted on the main frame fluidly connected to the blower and the vacuum hose for receiving the fractured soil material.

According to an embodiment, there is provided a method for making an excavation in a ground made of soil, the method comprising: using a fracturing hose connected to a compressor, applying a fluid pressure to the ground to fracture the soil; and while applying the fluid pressure, collecting the fractured soil using a vacuum hose in fluid communication with a blower driven by a motor which is separate and distinct from the compressor.

According to an embodiment, there is provided an aero-excavation apparatus for collecting a fractured soil material, the apparatus comprising: a main frame; a motor mounted on the main frame; a traction and direction system in driving arrangement with the motor for driving and operating the main frame; a blower in driving engagement with the motor; and a vacuum hose in fluid communication with the blower for collecting the fractured soil material; wherein when in operation, the motor drives the traction and direction system for driving and operating the main frame and the blower for providing the fractured soil material to be collected.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments there are disclosed aero-excavation apparatus for collecting fractured soil material and methods of operating aero-excavation apparatus for fracturing and removing soil material.

Figure 1A:
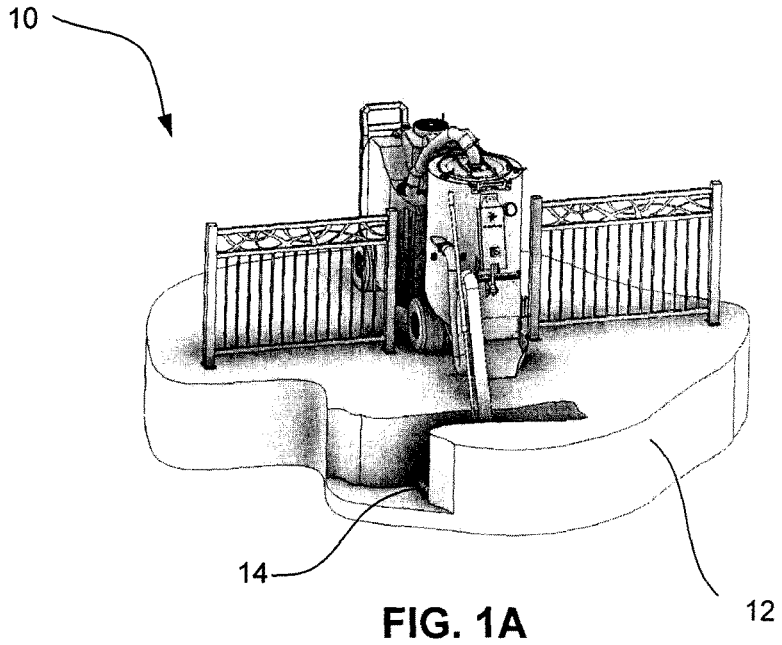
FIG. 1A is a perspective front view of an aero-excavation apparatus in its environment, in accordance with an embodiment.
Figure 1B:
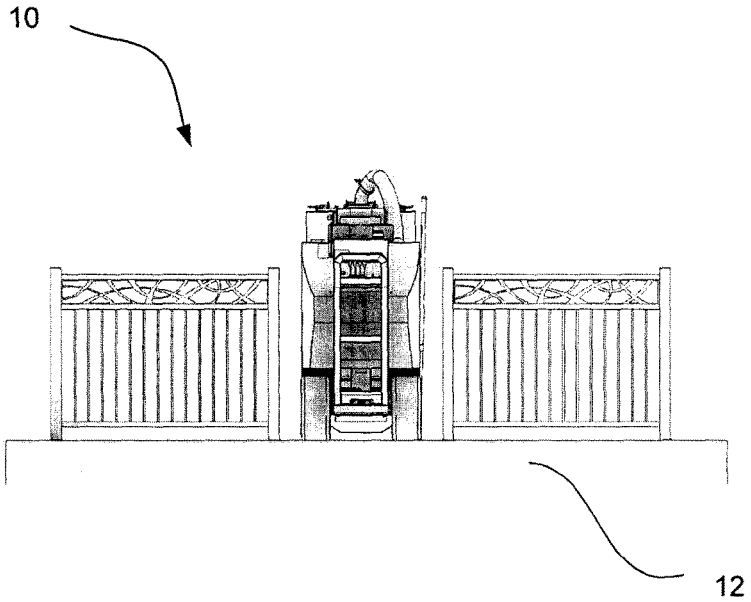
FIG. 1B is a rear elevation view of the aero-excavation apparatus in its environment of FIG. 1A.
Figure 1C:
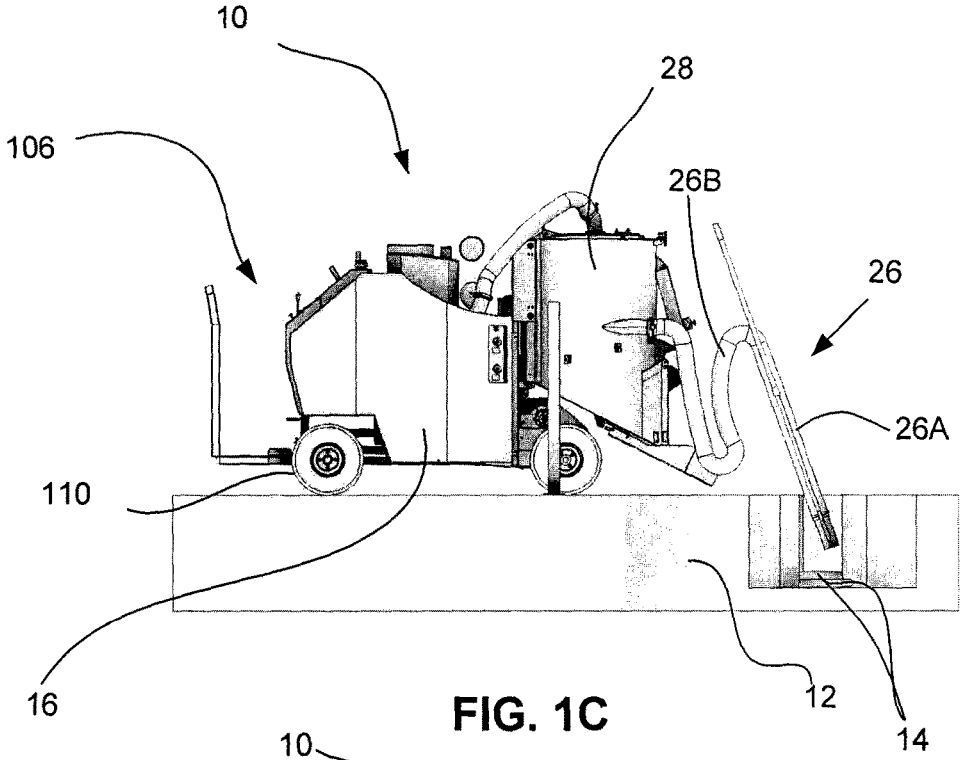
FIG. 1C is a side elevation view of the aero-excavation apparatus in its environment of FIG. 1A.

Referring now to the drawings, and more particularly to FIGS. 1A-1C, 2, 5A-5B, 6-12 and 20, there is shown an aero-excavation apparatus 10 (apparatus 10) for collecting a fractured soil material or a soil material 12 that has been fractured using a fracturing hose (not shown), and/or a shovel and similar equipment, in fluid communication with a compressor (not shown) such as, without limitation, fractured asphalt, sand, fractured rocks, and the like. The apparatus 10 speeds up the excavation time for locating public utilities 14, such as natural gas lines, water pipes, sewer lines, electric cables, fiber optic and the like (FIGS. 1A-1C).

The apparatus 10 for collecting the fractured soil material includes a main frame 16 and a motor 18 which is mounted on the main frame 16. The apparatus 10 further includes a traction and direction system 20, 22 which is in driving arrangement with the motor 18 for driving and operating the main frame 16. The apparatus 10 further includes a blower 24 (or a vacuum generating blower 24) which is in driving engagement with the motor 18 and a vacuum hose 26 which is in fluid communication with the blower 24 for collecting the fractured soil material. When in operation, the motor 18 drives the traction and direction system 20, 22 for driving and operating the main frame 16 and the blower 24 for providing the fractured soil material to be collected.

As shown in FIGS. 1A-18E, the apparatus 10 further includes a container 28 mounted on the main frame 16 and which is fluidly connected to the blower 24 and the vacuum hose 26 for receiving the fractured soil material. However, it is to be noted that the apparatus 10 may include a container 28 that is not mounted on the main frame 16, but that is about the main frame 16 while being fluidly connected to the blower 24 and the vacuum hose 26 for receiving the fractured soil material. According to this embodiment, the apparatus 10 would need to include a filter in its container 28 (as it will be better described below).

Figure 20:
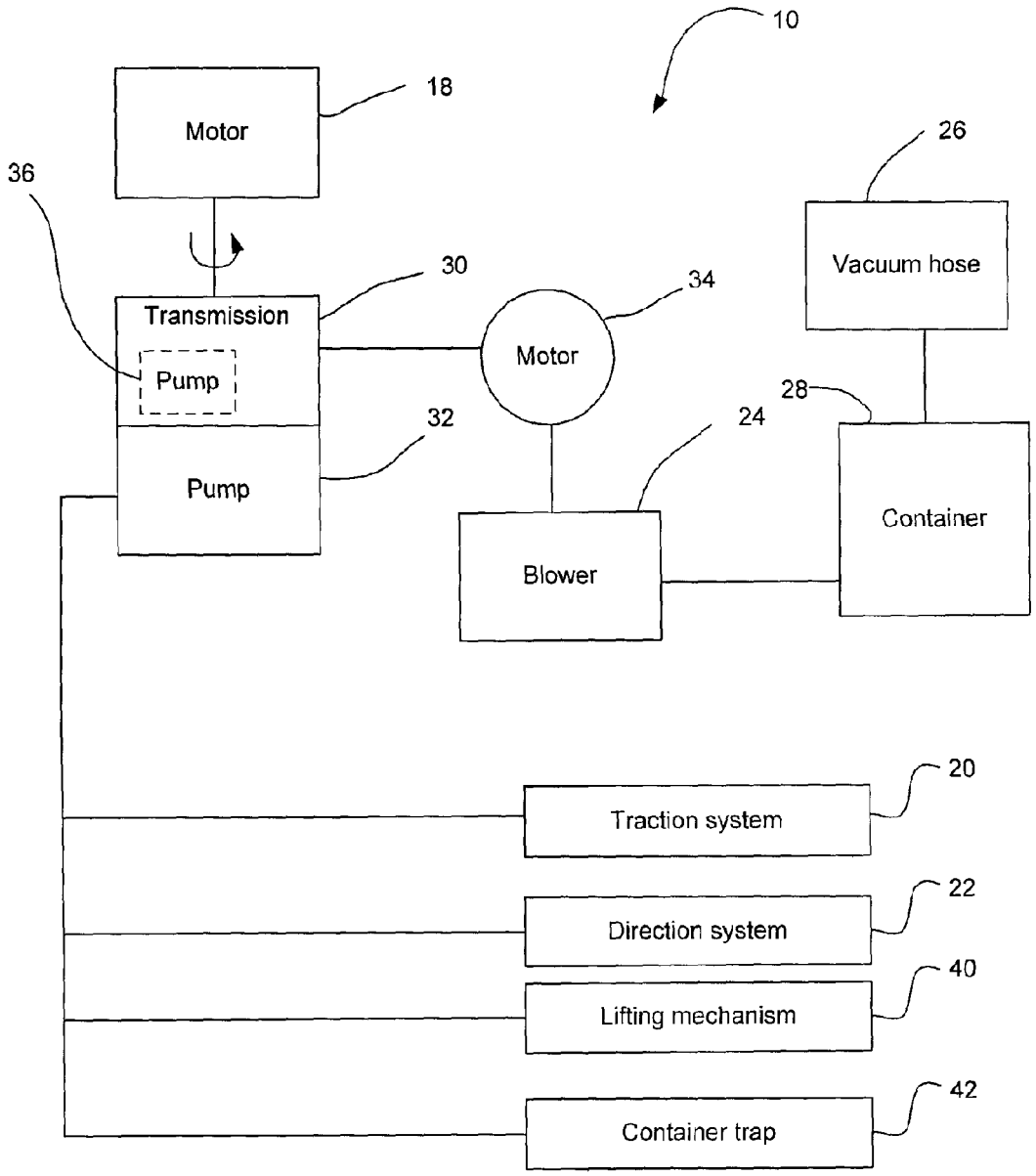
FIG. 20 illustrates a driving an operating system of an aero-excavation apparatus in accordance with another embodiment.

According to another embodiment and as shown in FIG. 20, the apparatus 10 may further include a transmission 30 operatively coupled to the motor 18 and a pump 32 operatively coupled to the motor 18.

According to another embodiment, the apparatus 10 may further include another motor 34 which is operatively coupled to the transmission 30 and the blower 24. The other mother 34 is understood to be part of the transmission 30. The transmission 30 may include a mechanical transmission comprising a gear box, a mechanical transmission which includes a centrifugal clutch and/or a continuously variable transmission and/or a hydraulic transmission.

According to another embodiment, the apparatus 10 may include the main frame 16, a motor 18 (i.e., diesel, gas, any fuel, etc.) mounted on the main frame 16, a hydraulic transmission 30 (i.e., hydraulic hydrostatic transmission) operatively coupled to the motor 18 and a hydraulic pump 32 operatively coupled to the motor 18 (or to the motor driveshaft). The apparatus 10 may further include another hydraulic pump 36 operatively to the hydraulic pump 32 (as the transmission 30 is a hydraulic transmission) and a hydraulic motor 34, which is operatively coupled to the hydraulic transmission 30 and the blower 24. As shown in FIG. 20, the traction system 20, the direction system 22, a lifting mechanism 40 (for lifting the container 28 relative to the main frame 16) and a container trap 42 (for closing an opening 44 in the container 28) are in driving arrangement with the hydraulic pump 32. As the second motor is, the second pump is being part of the hydraulic (hydrostatic) transmission. The second pump and second motor are transmission components.

For all possible configurations except for the hydrostatic one, a main gas engine drives a transmission which is coupled directly to a blower. According to the hydrostatic transmission configuration, a motor drives the blower, this motor being viewed as part of the transmission (not a separate motor).

According to another embodiment, the blower 24 may be a regenerative blower or regenerative turbine.

Referring now to FIGS. 5A, 5B, 8A and 8B, the apparatus 10 further includes the lifting mechanism 40 which is mounted on the main frame 16 (when the container 28 is mounted on the main frame 16). As described above, the lifting mechanism 40 is in driving arrangement with the motor 18 (via the transmission 30 and the hydraulic pump 32 for example) for displacing the container 28 relative to the main frame 16 between a first position (i.e., a normal position, FIGS. 5A and 8A) and a second position (a lifted position, FIGS. 5B and 8B). The lifting mechanism 40 includes a lifting frame 46 with one or more mating connector (not shown) for connecting with the container 28. The lifting mechanism 40 may include releasable mating connector (not shown) for releasably connecting with the container 28 or fixed mating connector for fixedly connecting with the container 28. The lifting mechanism 40 may further include a bottom plate (not shown) for supporting the container 28 between its normal and lifted positions. Thus, the lifting mechanism 40 may include any configuration such as to allow a worker/a driver to displace the container 28 relative to the main frame 16 between its normal position and its lifted position (or any other position, the displacement may be other than a vertical displacement). It is to be mentioned that the lifting mechanism 40 may be operatively coupled to the motor 18, but that it can also be only mechanically connected to the main frame 16 such as to allow the worker/driver to mechanically displace the container 28 between its normal position and its lifted position. Thus, when the container opening 44 at the bottom of the container 28 is too low for the collected fractured soil material to be transferred into another other recipient (not shown) or on the ground, the container 28 can be lifted using the lifting mechanism 40 to elevate the container opening 44 of the container 28.

Figure 3:
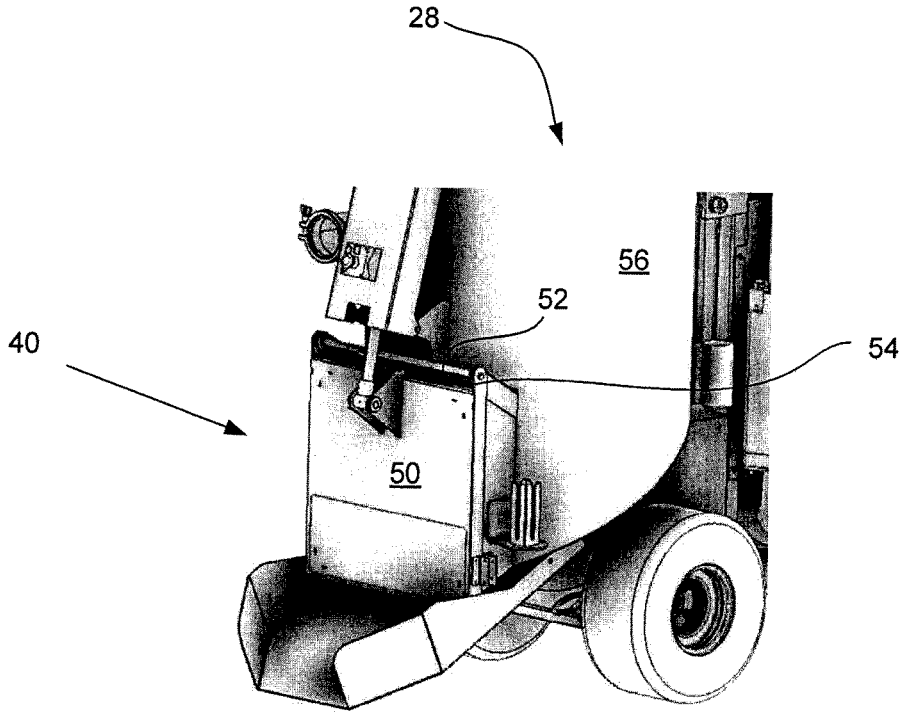
FIG. 3 is a close up view of a container of the aero-excavation apparatus of FIG, 1A, where a container trap is in its closed position.
Figure 4:
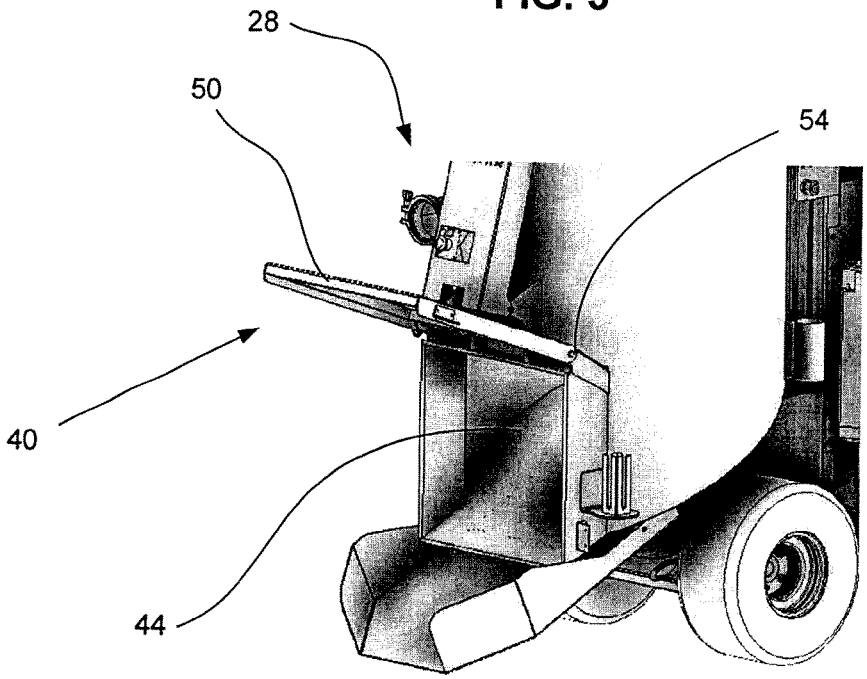
FIG. 4 is a close up view of the container of the aero-excavation apparatus of FIG, 1A, where the container trap is in its opened position.
Figure 5A:
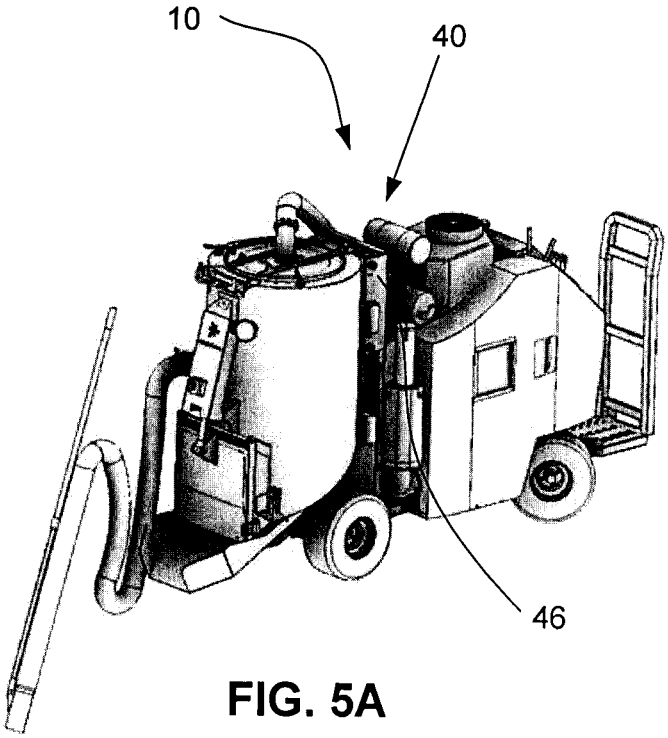
FIG. 5A is another perspective view of the aero-excavation apparatus of FIG. 1A, where the container is in its normal position.
Figure 5B:
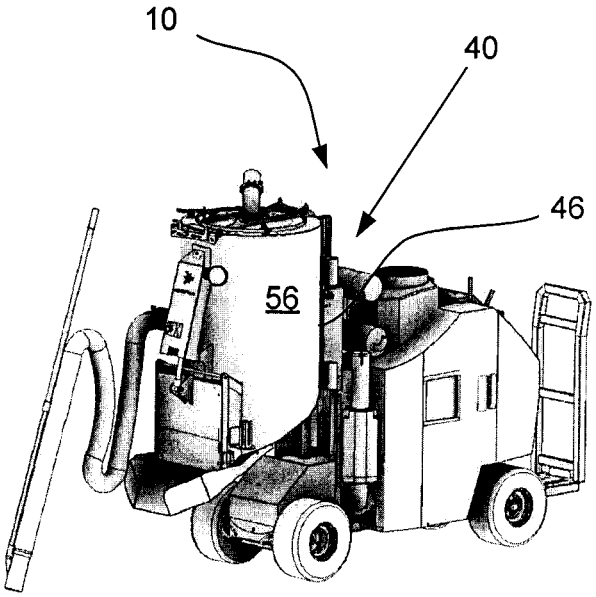
FIG. 5B is another perspective view of the aero-excavation apparatus of FIG. 1A, where the container is in its lifted position.
Figure 6:
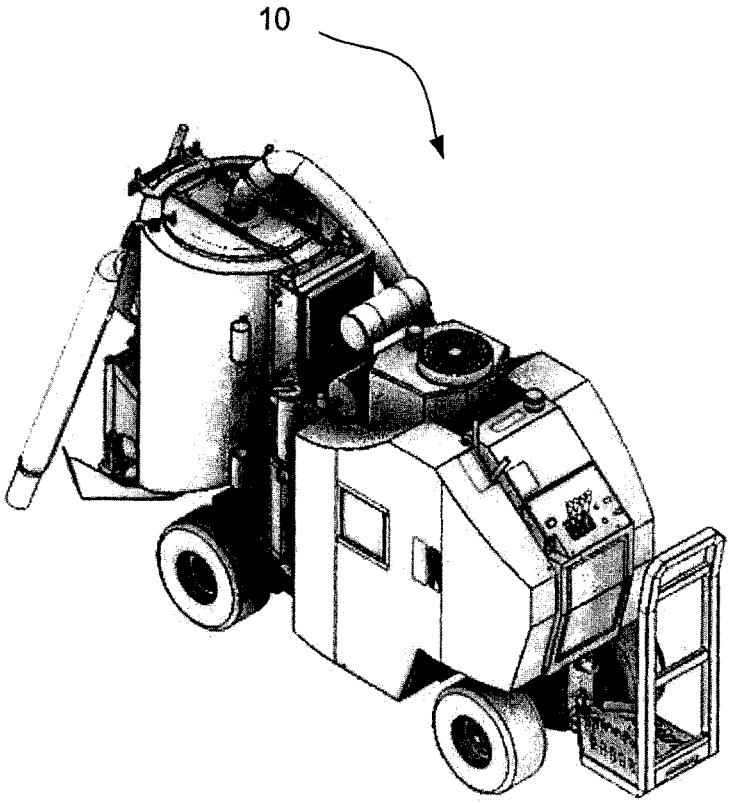
FIG. 6 is a rear perspective view of the aero-excavation apparatus of FIG. 1A.
Figure 7:
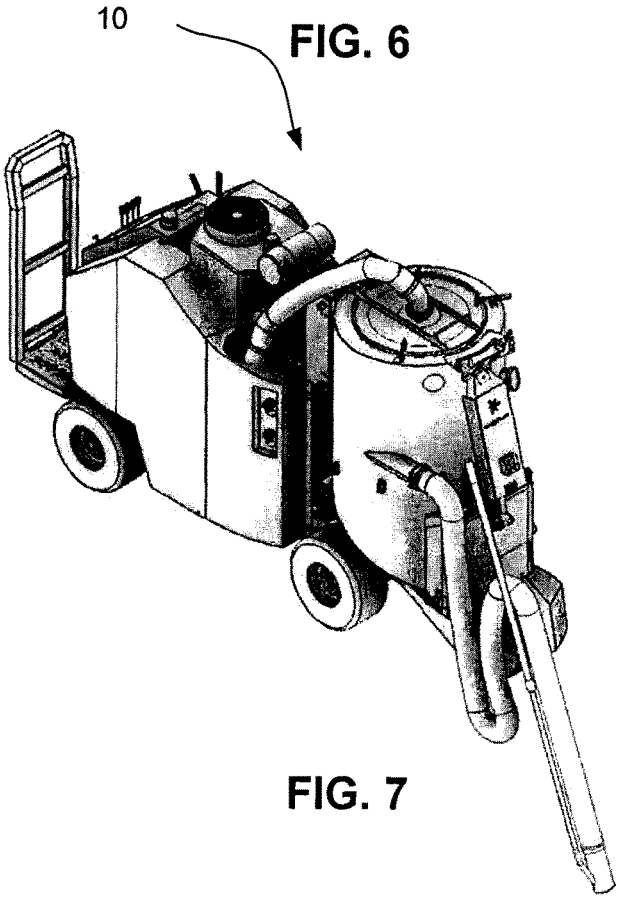
FIG. 7 is a front perspective view of the aero-excavation apparatus of FIG. 1A.
Figure 8A:
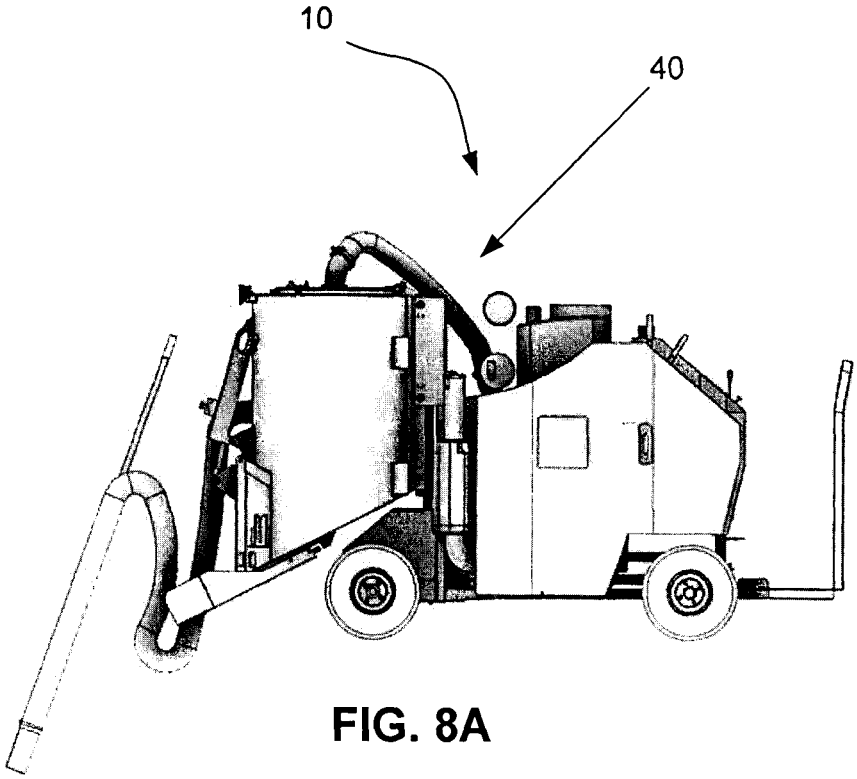
FIG. 8A is a side elevation view of the aero-excavation apparatus of FIG. 1A, showing the container in its normal position.
Figure 8B:
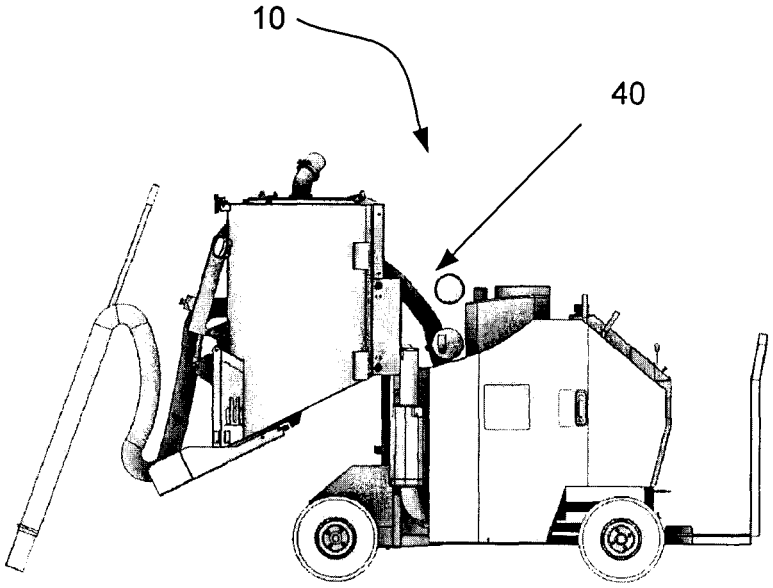
FIG. 8B is a side elevation view of the aero-excavation apparatus of FIG. 1A, showing the container in its lifted position.
Figure 9:
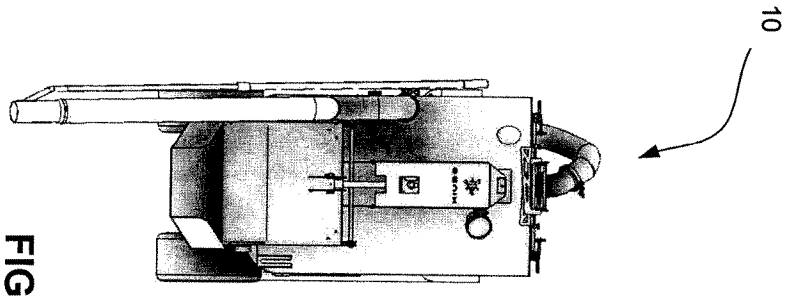
FIG. 9 is a front elevation view of the aero-excavation apparatus of FIG. 1A.
Figure 10:
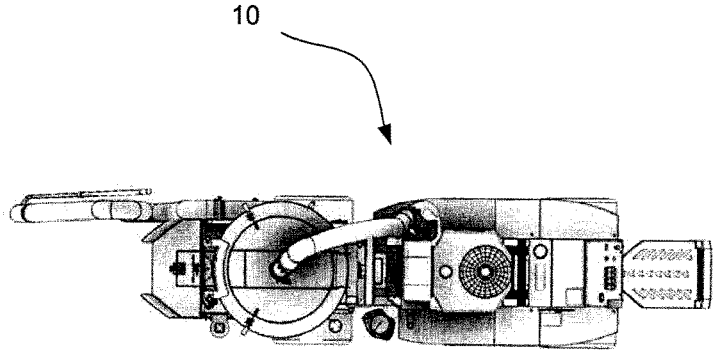
FIG. 10 is a top plan view of the aero-excavation apparatus of FIG. 1A.
Figure 11:
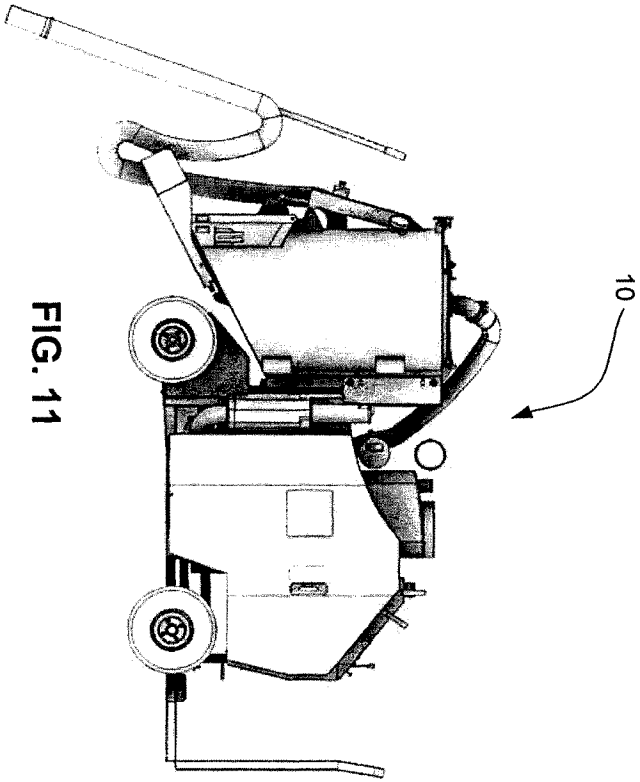
FIG. 11 is another side elevation view of the aero-excavation apparatus of FIG. 1A, showing the container in its normal position.
Figure 12:
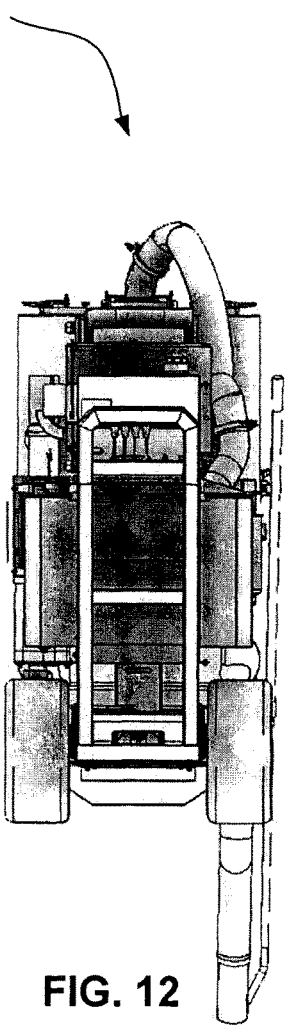
FIG. 12 is a rear elevation view of the aero-excavation apparatus of FIG. 1A.

As better shown in FIGS. 3 and 4, the container 28 further includes the container opening 44. Accordingly, the apparatus 10 further includes a container trap 42 for closing the container opening 44. As shown in FIGS. 3 and 4, the container trap 42 is in driving arrangement with the motor 18 for allowing the container trap 42 to displace between a closed position (FIG. 3) and an opened position (FIG. 4). It is to be mentioned that the container trap 42 may be operatively coupled to the motor 18, but that it can also be only mechanically connected to the main frame 16 and/or to the container 28 such as to allow the worker/driver to mechanically displace the container 28 between its closed position (FIG. 3) and its opened position (FIG. 4). The container trap 42 includes a main section 50 which has an upper edge 52. The main section 50 is for covering the container opening 44. The container trap 42 further includes a hinge 54 mounted on an exterior wall 56 of the container 28 for pivotably connecting with the upper edge 52 of the main section 50. It is to be noted that the container trap 42 may include any configuration such as to allow the container opening 44 to be closed via the container trap 42 when in its closed position. It is to be noted that the connection at the upper edge 52 may be replaced by a connection at a lower edge (not shown). The container trap may further include a ramp 43 for directing the compacted collected soil material.

According to another embodiment, the container trap 42 may be a slidable door or any other door configured to close the container opening 44.

Figure 13:
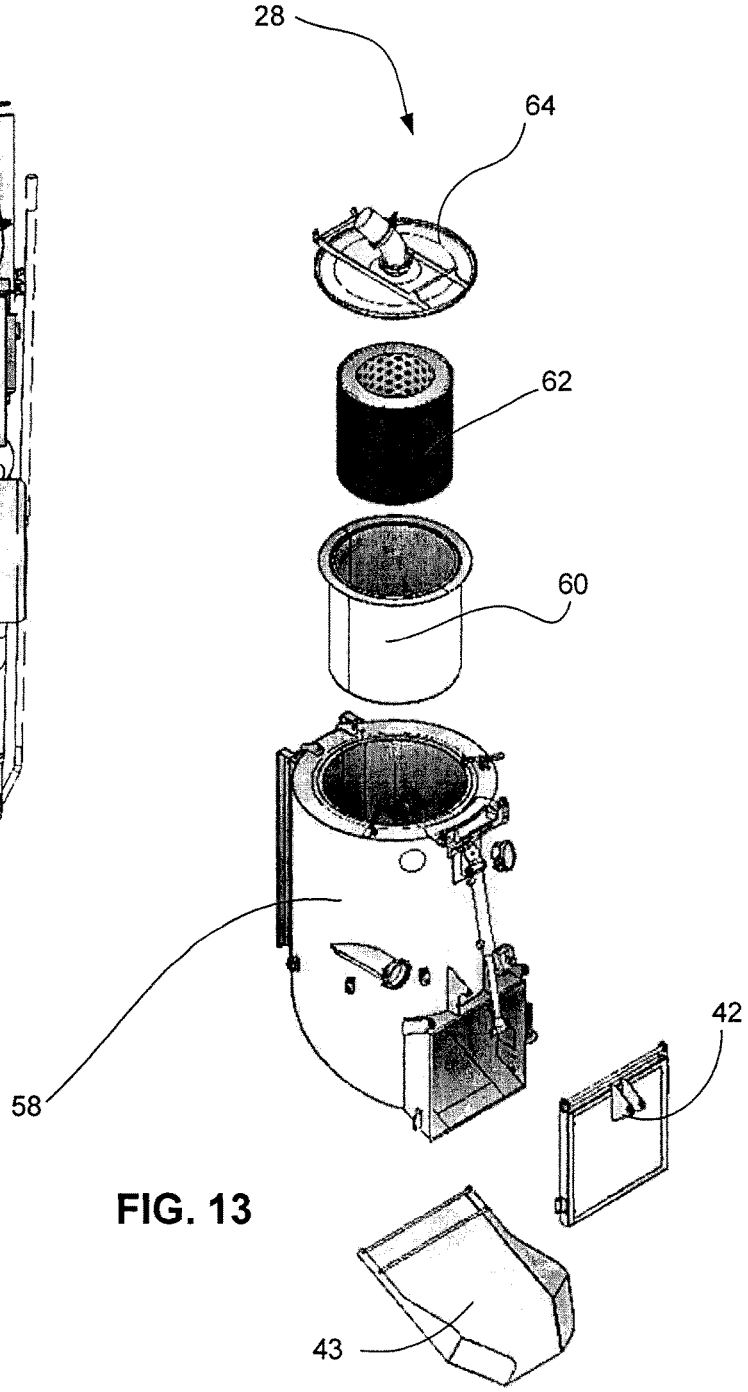
FIG. 13 is an exploded perspective view of the container of the aero-excavation apparatus of FIG. 1A.

Referring now to FIG. 13, there is shown that the container 28 includes a tank 58, a filter guard container 60 received in the tank 58 and a filter 62 received in the filter guard container 60 for filtering the collected fractured soil material. The container 28 also includes a container lid 64 for closing a top opening 66 defined by the tank 58. The filter 62 is used to filter air received in the container 28 and to remove debris from it.

Figure 17A:
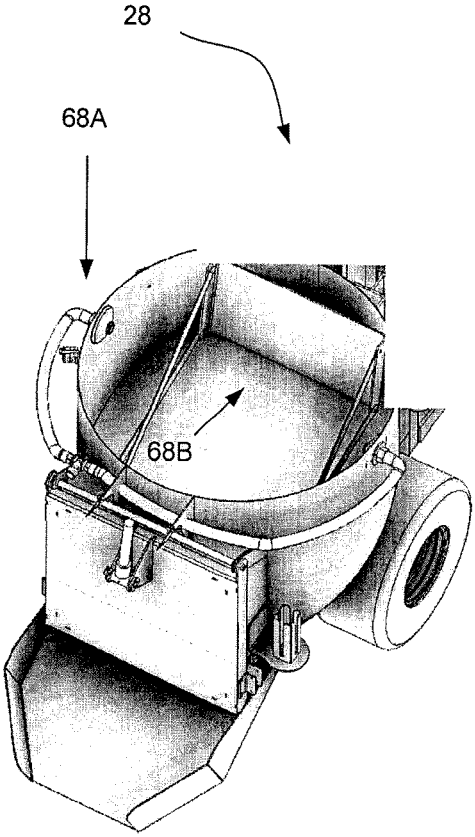
FIG. 17A is a perspective cross-sectional view of a container, in accordance with another embodiment, where the container includes material removal devices, one of them being shown in its extended position.
Figure 17B:
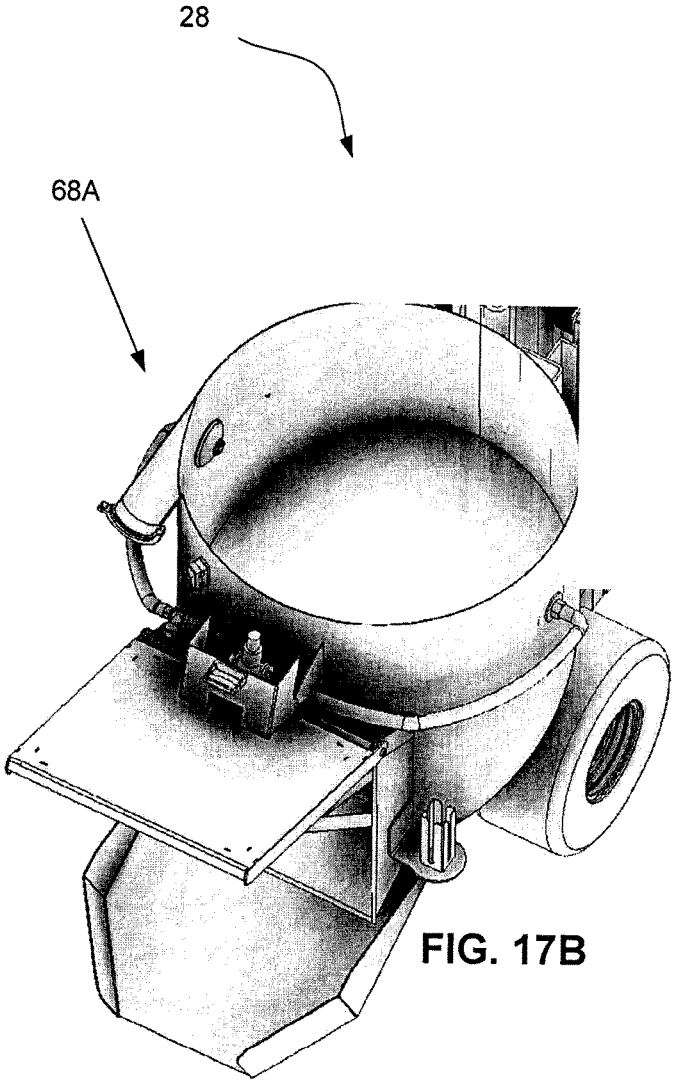
FIG. 17B is a perspective cross-sectional view of a container, in accordance with another embodiment, where the container includes material removal devices, one of them being shown in its retracted position.
Figure 17C:
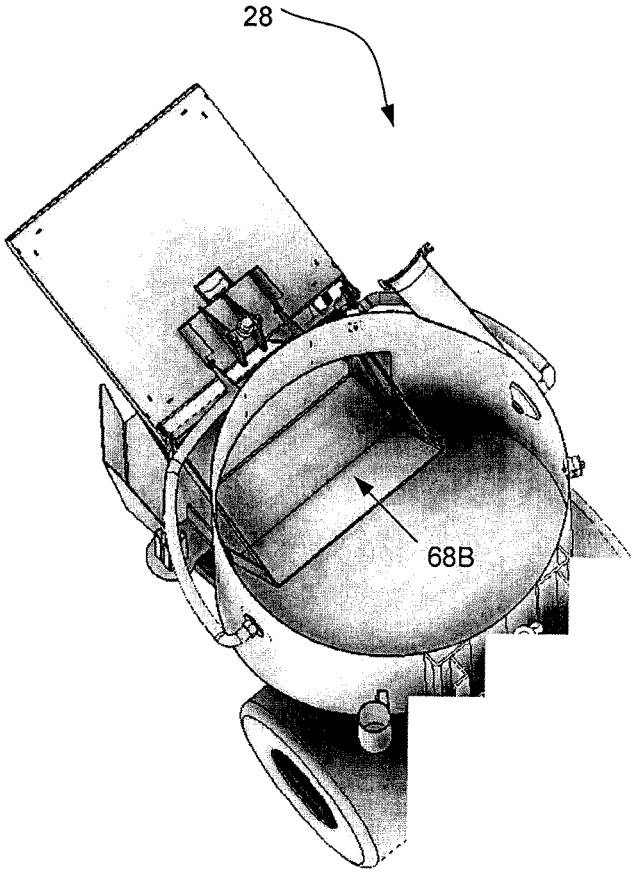
FIG. 17C is a perspective cross-sectional view of the container of FIG. 17A, where one of the material removal devices is in its retracted position.
Figure 17D:
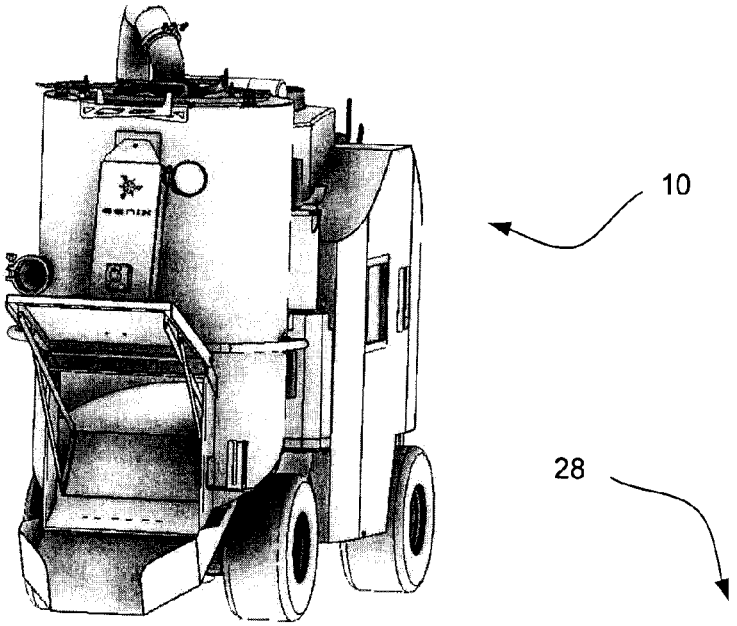
FIG. 17D is a perspective view of the container of FIG. 17C, where one of the material removal devices is shown in its retracted position.
Figure 17E:
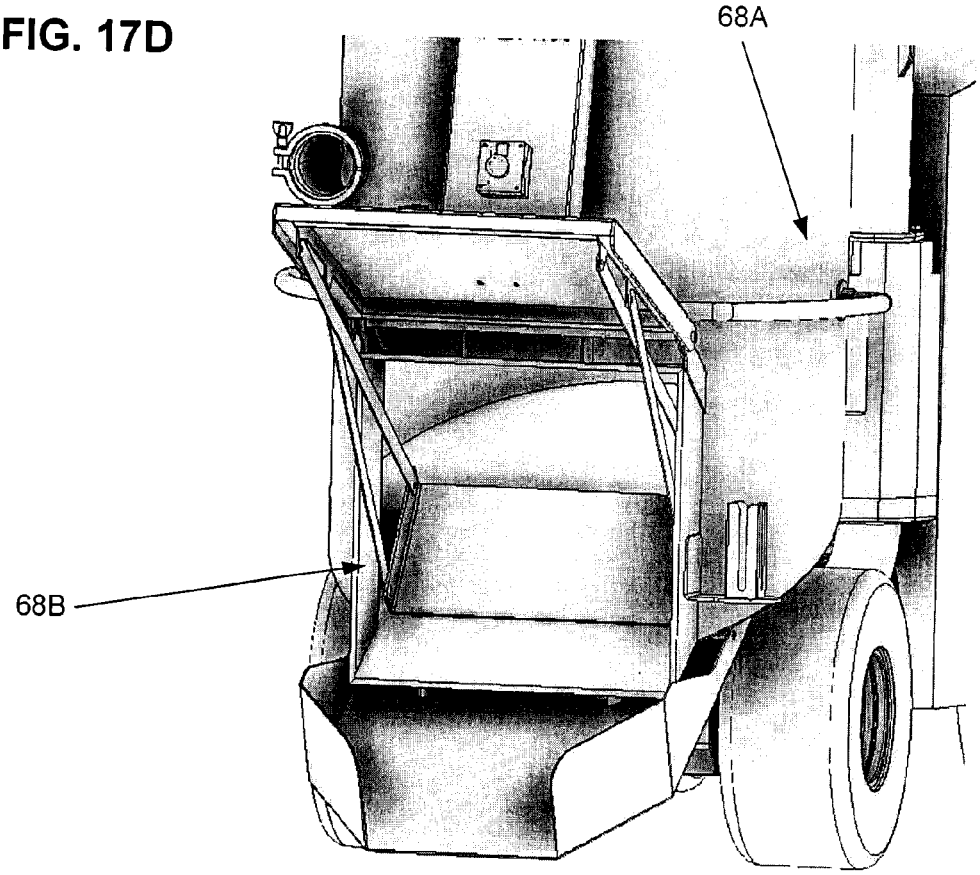
FIG. 17E is a close up view of the container of FIG. 17D.
Figure 17F:
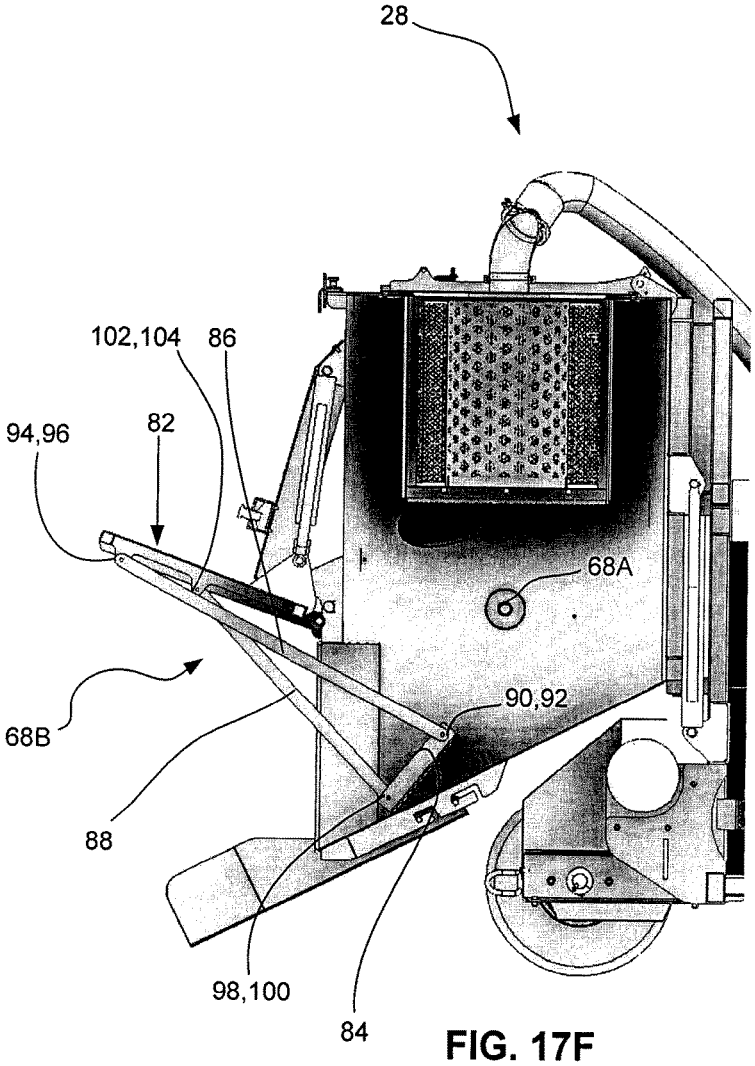
FIG. 17F is a cross-sectional side elevation view of the container of FIG. 17C.
Figure 17G:
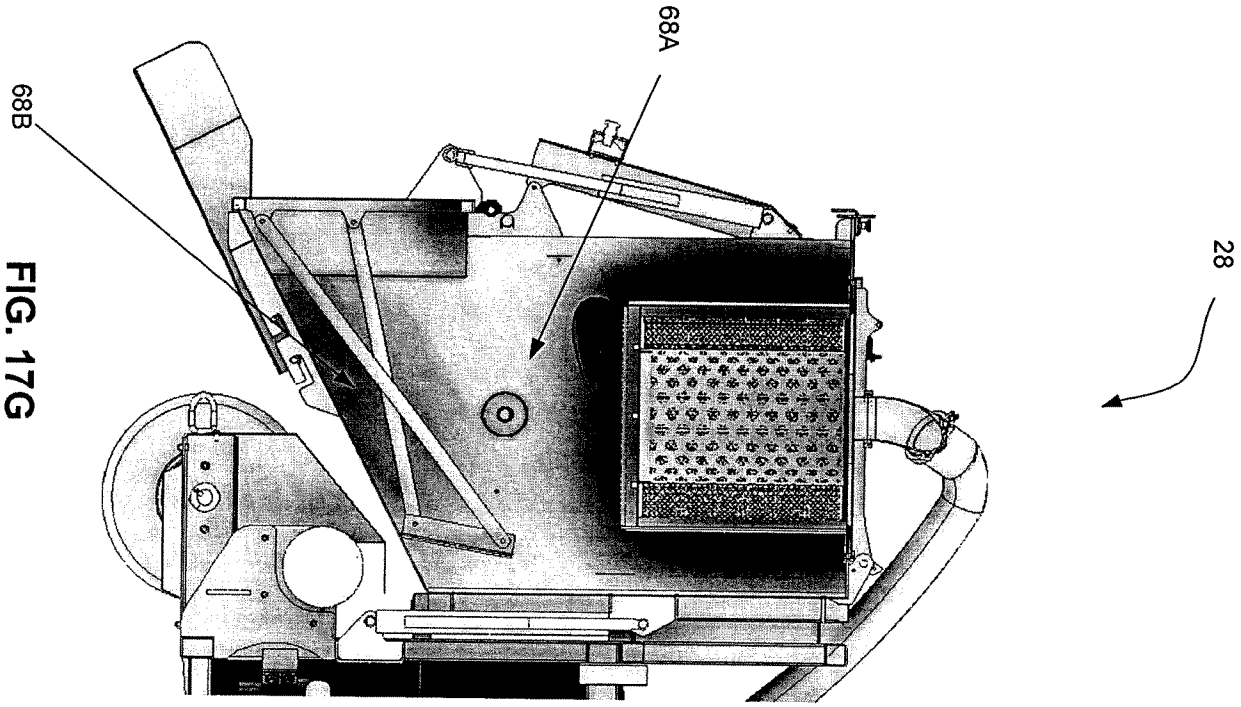
FIG. 17G is a cross-sectional side elevation view of the container of FIG. 17A.
Figure 17H:
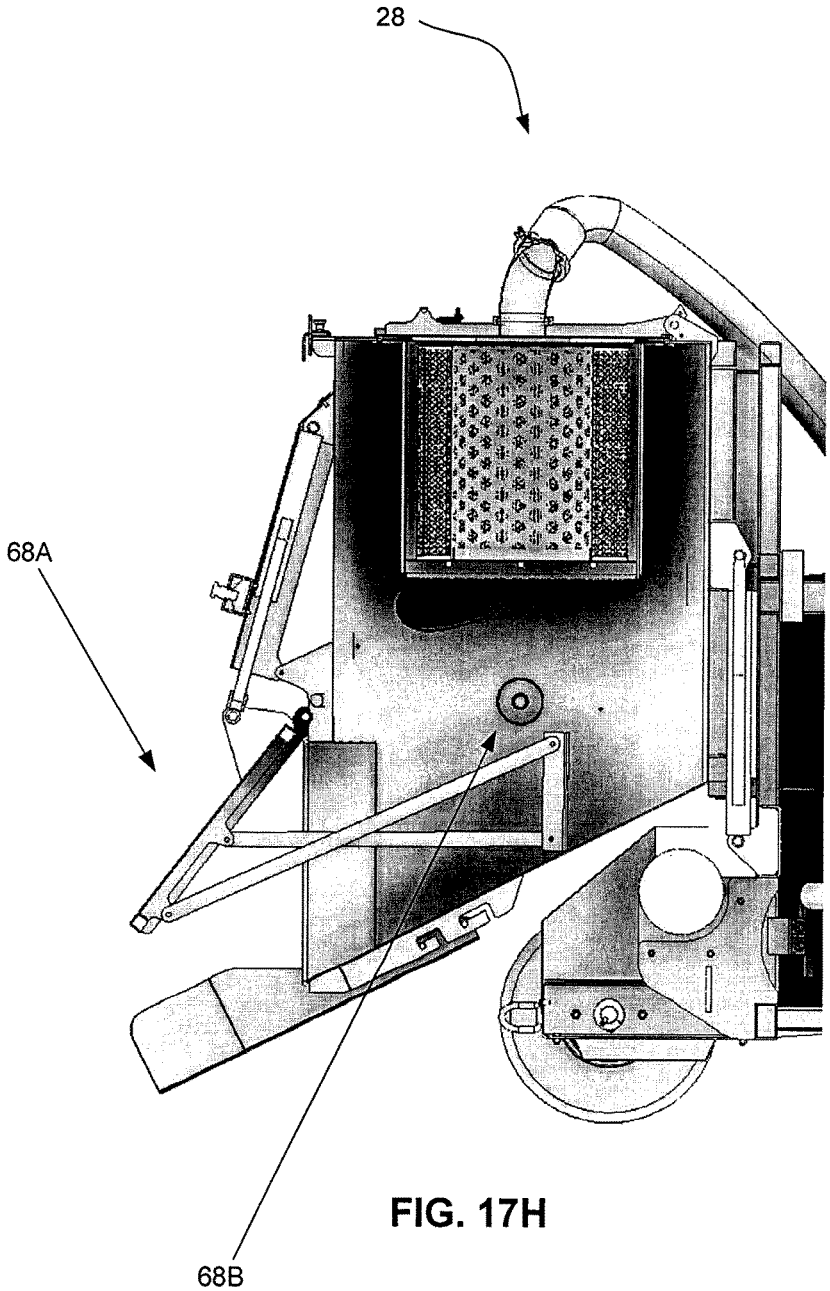
FIG. 17H is a cross-sectional side elevation view of the container, where one of the material removal device is shown in a position between its extended position (FIG. 17A) and its retracted position (FIG. 17C)
Figure 18A:
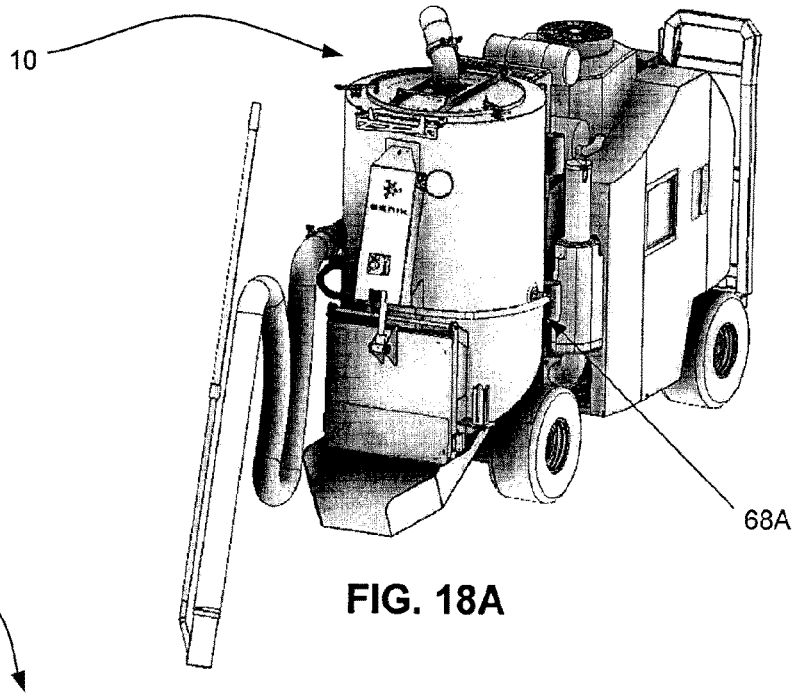
FIG. 18A is a perspective view of an aero-excavation apparatus in accordance with another embodiment.
Figure 18B:
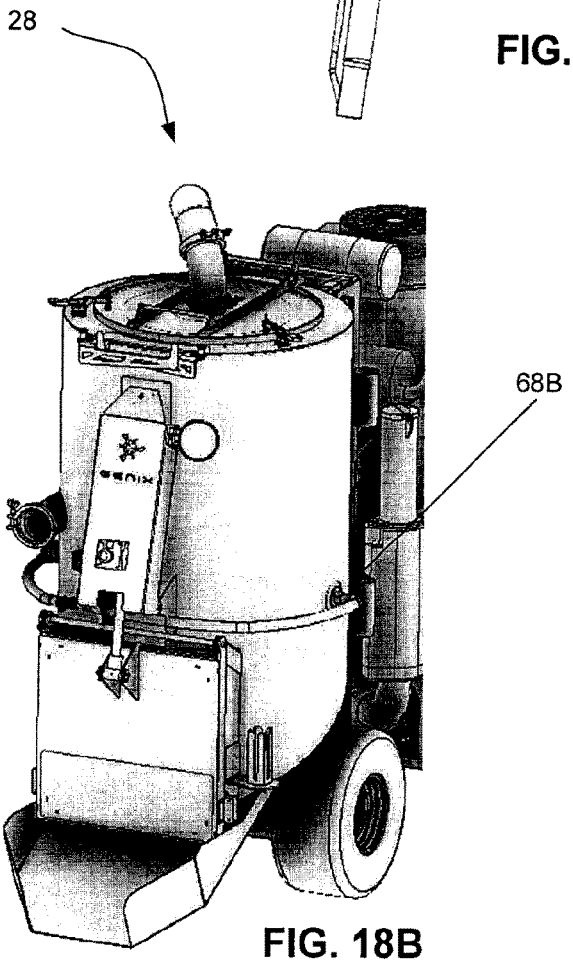
FIG. 18B is a close up view of a container of the aero-excavation apparatus of FIG. 18A.
Figure 18C:
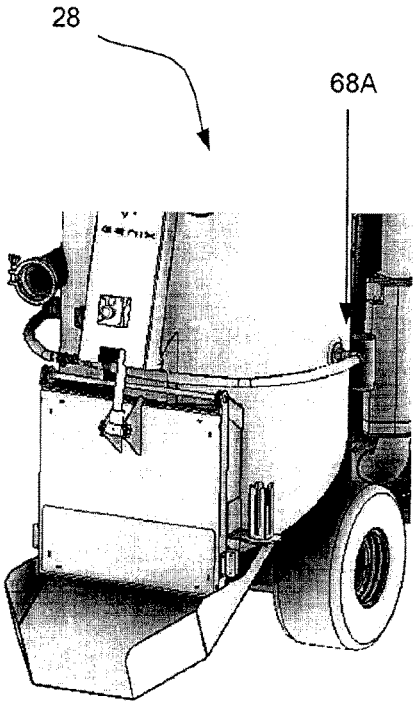
FIG. 18C is a is a close up view of a container trap of the aero-excavation apparatus of FIG. 18A.
Figure 18D:
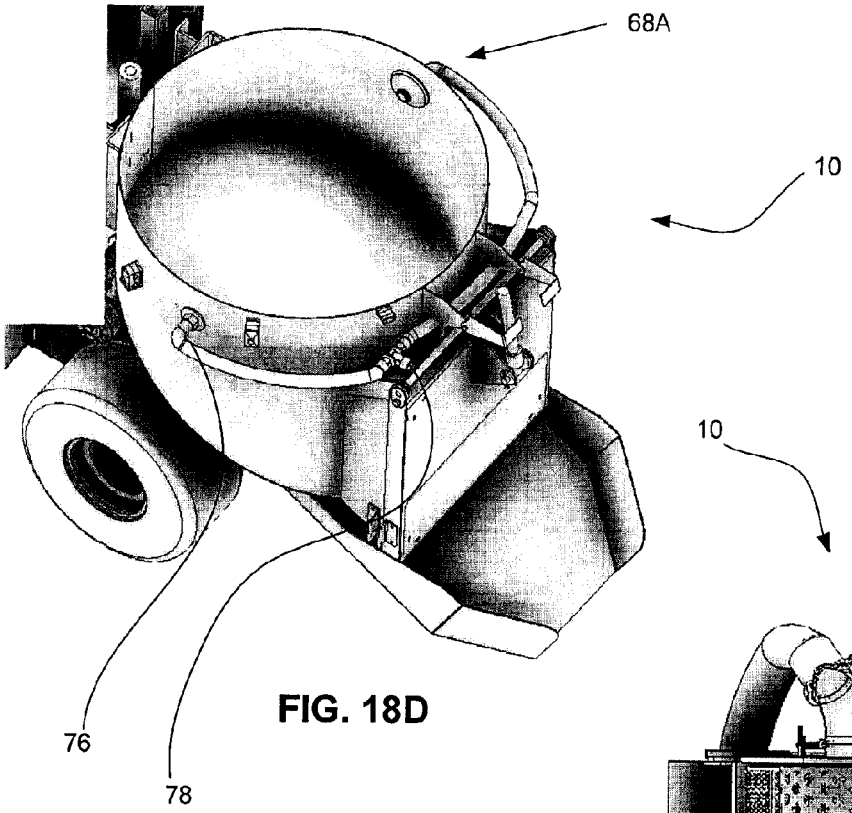
FIG. 18D is a perspective cross-sectional view of the container of the aero-excavation apparatus of FIG. 18A, showing a material removal device.
Figure 18E:
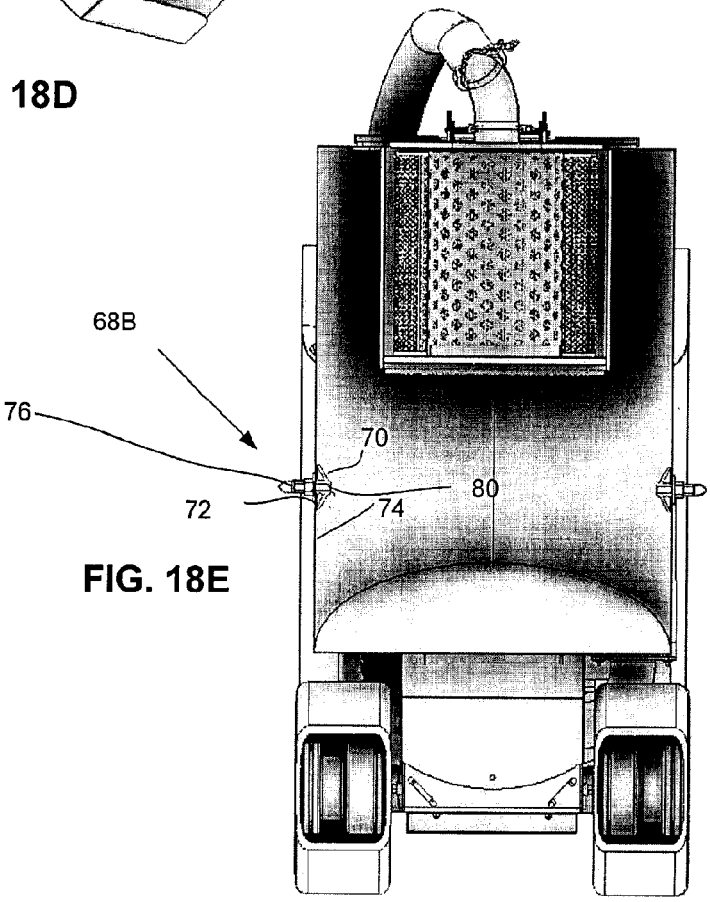
FIG. 18E is a cross-sectional front elevation view of the container of the aero-excavation apparatus of FIG. 18A, showing the material removal device.

Referring now to FIGS. 17A-17H and 18A-18E and according to other embodiments, there is shown that the apparatus 10 may further include one or more material removal device(s) 68A, and/or 68B mounted on the container 28 and/or on the main frame 16 for providing the collected fractured soil material (that is compacted within the main frame 16) to exit the container opening 44 when the container trap 42 is in the opened position. As shown in FIG. 17A, the apparatus 10 includes a first material removal device 68A and a second material removal device 68B. The first material removal device 68A includes a vibration plate 70 which defines a concave surface 72 (FIG. 18E) facing an interior peripheral wall 74 of the container 28. The first material removal device 68A further includes an elongated hollow member 76 extending from the concave surface 72 towards to and away from the interior peripheral wall 74. The elongated hollow member 76 defines a first end 78 and a second end 80. The first end 78 of the elongated hollow member 76 is adapted to receive compressed fluid (i.e., compressed air, from the fracturing hose used in the fracturing of the soil material). Thus, in operation, the worker/driver of the apparatus 10 may provide first the compressed fluid (i.e., compressed air) towards the second end 80 of the elongated hollow member 76 and second towards and along the concave surface 72 in a way to provide the vibration plate 70 to be distanced from the interior peripheral wall 74 of the container 28 and to vibrate. This configuration of the first material removal device 68A provides the compressed fluid or compressed air to circulate within the collected fractured material contained in the container 28.

As shown in FIGS. 17A, 17C-17H, there is shown that the second material removal device 68B may include a raking device 82. The raking device 82 is configured to displace between an extended position (FIG. 17G) for receiving the collected fractured soil material in the container 28 and a retracted position (FIG. 17F) for raking the collected fractured soil material outside the container opening 44. As shown in FIGS. 17A, 17C-17H, the raking device 82 may be connected to the container trap 42. As such, when the container trap 42 is in its opened position, then the raking device 82 follows by being in its retracted position. However, when the container trap 42 is in its closed position, then the raking device 82 follows by being in its extended position. The raking device 82 includes a raking plate 84 and a first and second raking arms 86, 88 extending between the raking plate 84 and the container trap 42. The raking device 82 includes first and second raking arms 86, 88 on each side of the raking plate 84. The first raking arm 86 includes a first pivot 90 at its first end 92 and a second pivot 94 at its second end 96. The second raking arm 88 also includes a first pivot 98 at its first end 100 and a second pivot 102 at its second end 104. The first and second raking arms 86, 88 are thus configured for pivoting relative to the container trap 42 and the raking plate 84 such as to displace the raking device 82 between its retracted position and its extended position. It is to be noted that the raking device 82 may include any other configuration such as to provide a raking movement to help the collected fractured soil material to exit the container 28 via the container opening 44. The material removal device may alternatively be replaced by a worm drive removal device.

Figure 2:
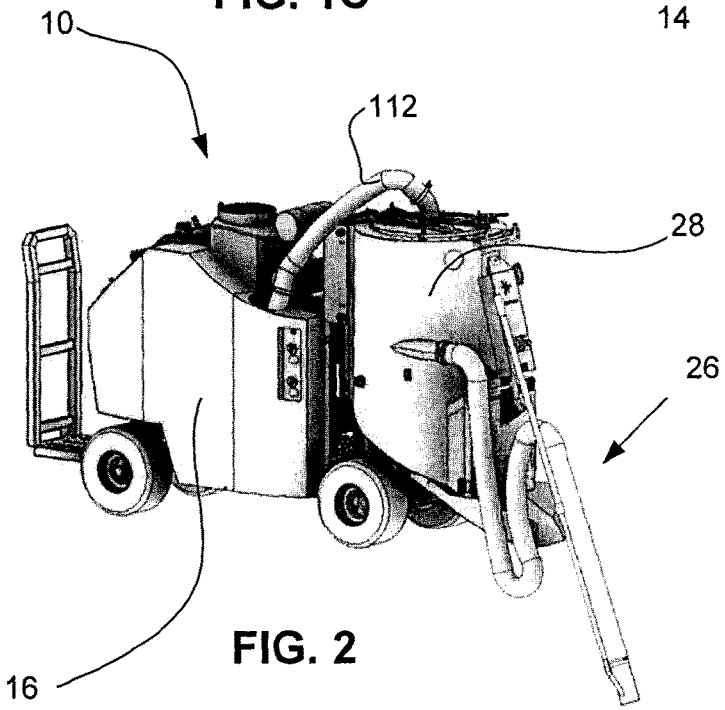
FIG. 2 is a perspective view of the aero-excavation apparatus of FIG. 1A.

As better shown in FIG. 2, the vacuum hose 26 includes a hose section 26A and a nozzle section 26B which extends from the hose section 26A.

The apparatus 10 further includes a driving area 106 within the main frame 16 for allowing a driver to drive and operate the main frame 16.

According to another embodiment, the apparatus 10 may further includes a control system for controlling the motor 18, the traction and direction system 20, 22 and/or the blower 24.

Figure 19:
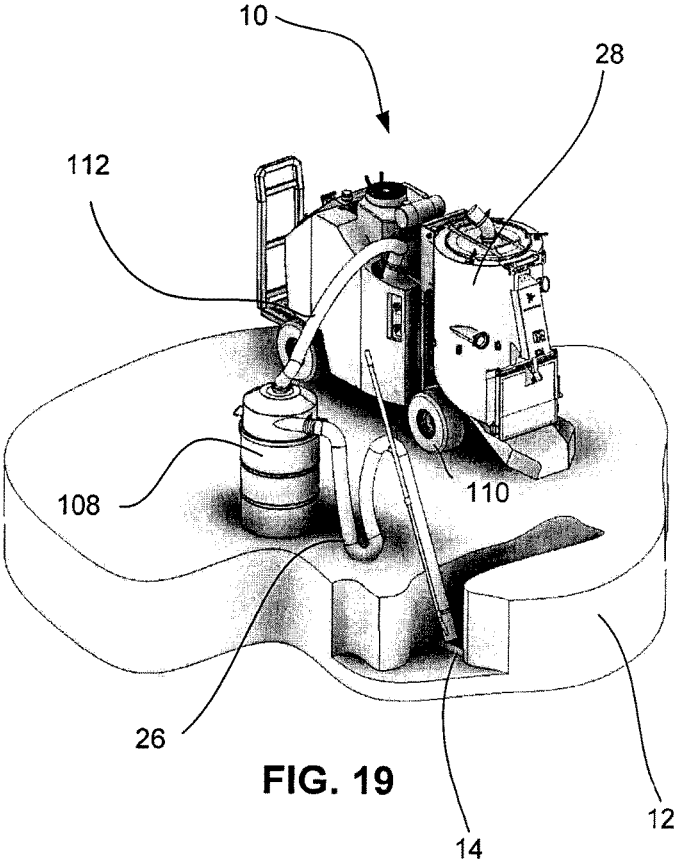
FIG. 19 is a perspective view of an aero-excavation apparatus in its environment, in accordance with another embodiment.

According to another embodiment and referring now to FIG. 19, the apparatus includes a first container 28 that is mounted on the main frame 16 and a second container 108 which is about the main frame 16. The second container 108 is fluidly connected to the blower 24 and the vacuum hose 26 for collecting/receiving the fractured soil material. The second container 108 may be used in an environment where the fractured soil material to be collected is difficult to reach when driving and operating the main frame 16. According to this embodiment, the container 28 needs to include a filter, such as the one described above.

As shown, the main frame 16 is supported by wheels 110. In use, the apparatus 10 may be independently used with a compressor (not shown). The compressor may be mounted on an adjacent trailer, near the main frame 14. The compressor provides compressed fluid or compressed air (or water) for a fracturing operation which involves a fracturing hose (not shown). The fracturing hose has a first end and a second end. The fracturing hose is fluidly connected to the compressor at its first end for receiving the compressed air. The fracturing hose may further have a nozzle at its second end for directing the compressed air from the compressor at a high pressure and at a requested velocity towards the soil material to be fractured. Accordingly, the fracturing hose (not shown) and the compressor (not shown) are understood to be separate equipment that is not included in the apparatus 10. However, it is to be noted that the fracturing hose and the compressor may alternatively be connected to the apparatus 10. Once the soil material is fractured by the worker, the apparatus 10 may help in collecting the fractured soil material.

When the apparatus 10 is in operation, the compressor (not shown) and the vacuum hose 26 are independently operable which means that one worker can fracture the soil material at an excavation site by directing the nozzle of the fracturing hose towards the soil material to be fractured while another worker can vacuum/collect the fractured soil material using the vacuum hose 26 since the compressor/fracturing hose and the vacuum hose 26 are independently operable.

According to another embodiment, the main frame 16 may be made of any material. The main frame 16 may include, without limitation, metallic materials, plastic materials, composite materials, and the like.

According to another embodiment, the main frame 16 may be supported by three, four wheels 110 or any number of wheels 110 such as to allow a driver/worker to be installed in the driving area 106 for driving and/or operating the main frame 16. The main frame 16 may also be supported by track (crawler type) support and traction. The driver/worker may be seated or standing on/within the driving area 106.

According to another embodiment, the driving area 106 may include a seat (not shown) for allowing the driver/worker to be seated. The seat may be a removable seat. The driving area 106 may also be covered by a shield (not shown) for allowing the driver to maneuver the apparatus 10 at different temperatures and external conditions. The driving area 106 may also integrate a user interface (not shown) for providing to the driver/worker a plurality of operation data such as, without limitation, the pressure of the vacuum compressed air, the velocity of the vacuum compressed air at the nozzle of the vacuum hose, the soil temperature and characteristics, external temperature and pressure, the position of the container trap 42, the position of the container 28, the speed of the main frame 16 and the like.

According to another embodiment, the interface may interact with level/temperature/pressure instruments (not shown) mounted on, without limitation, the main frame 16, the traction and direction system 20, 22, the compressor, the fracturing hose, the container 28 and/or the vacuum hose 26 for providing the plurality of operation data.

According to another embodiment, the fracturing hose may include a rigid hose section made of a rigid material such as to contain the compressed air provided by the compressor. The fracturing hose may also include a flexible hose section such as to provide the worker to reach an excavation site which is at a certain distance from the apparatus 10, the main frame 16 or the compressor (not shown).

According to another embodiment, the fracturing hose may include a venturi within the nozzle for increasing the velocity of the compressed air at the second end of the fracturing hose which needs to be directed to the soil material to be fractured.

According to another embodiment, the vacuum hose 26 and/or the fracturing hose may further include one or more handles (not shown) such as to allow the worker to support the vacuum hose 26 and/or the fracturing hose to precisely direct their respective ends towards the fractured soil material to be collected or the soil material to be fractured. The handle(s) may be releasable, retractable, adjustable and the like.

According to another embodiment, the container opening 44 of the container 28 is sealed by the container trap 42. When the container trap 42 is in the closed position, the container 28 is sealed, the collected fractured soil material is captured within the container 28 and the fracturing/removing operations can be properly made. However, when the container trap 42 is in the opened position, the container 28 is not sealed (i.e., the removing/fracturing operation are normally stopped) and the collected fractured soil material can escape the container 28. When the container trap 42 is in its opened position, the fractured and removed material can be transferred to another recipient such as, for example, a wheelbarrow, or can be replaced where it belongs.

According to another embodiment, the container 28 may include the container opening 44 at another place on the exterior wall 56 of the container 28. For example, the container 28 may only include the container lid 64 at the top of the container 28 such that when the container 28 is full of collected fractured soil material, the container 28 may be lifted by the lifting mechanism 40 and dump in another recipient (i.e., like with the trash bins lifted by and dump in the garbage truck).

According to another embodiment, the main frame 16 may further include gas and/or oil reservoir in fluid communication with one of the motor 18 and/or the blower 24.

As shown, the vacuum hose 26 and the blower 24 are in fluid communication via a connecting hose 112 (i.e., air tight connecting hose). Additionally, the apparatus 10 may further include one or a plurality of filters for filtering the air that is vacuumed by the vacuum hose 26 and returned to the compressor and the fracturing hose as compressed air. The vacuumed air could be reused at the exhaust of the blower as compressed air (the blower is able to produce vacuum and air compression, even both at the same time) to feed a fracturing hose. It could theoretically be possible to force feed an air compressor thereof creating a two stage compressor. The blower exhaust should be presented as a possible source of compressed air to be used by the fracturing hose. It is to be noted that the filters at the entrance and exit of the compressor should not avoid a good suction (i.e., upstream and downstream of the compressor). Thus, the filters should have an important surface area and the surface area at the entrances and exits of the filters should equal the diameters of the inlet and/or outlet(s) of the compressor.

According to another embodiment, the vacuum hose 26 of the apparatus 10 may have a diameter of about 100 mm for about 650 cfm (cubic feet per minute) of vacuumed air.

According to another embodiment, the apparatus 10 may be powered by a 37 hp motor with a vertical drive shaft.

According to another embodiment, the fracturing hose (i.e., or pistol) which is used for the soil breakdown in combination with the apparatus 10 may be powered by a compressor that is not found to be on the apparatus 10.

According to another embodiment, the dimensions of the apparatus 10 may be about 915 mm width, about 2200 mm length and about 1500 mm height. It is to be noted that the apparatus 10 (i.e., micro-mobile aero-excavation unit) may adopt any other suitable dimensions to attend its specific use of being operable in restraint areas.

According to another embodiment, the apparatus 10 is a compact apparatus 10 which can be used in restricted places and areas such as, without limitations, back lots, parking lots, garages, and the like.

According to another embodiment, the apparatus 10 reduces the excavation foot prints compared to well-known apparatus and methods.

According to another embodiment, the apparatus 10 speeds up the excavation time for locating public utilities, such as natural gas lines, water pipes, sewer lines, and the like (FIGS. 1A-1C).

The compressor may be a 185 CFM/100 PSI compressor (i.e., mounted on an adjacent trailer).

The length of the fracturing hose may be of about 150' from the compressor with about 1" in diameter.

The vacuum hose 26 may have a diameter of about 4" and a flux of about 350 to about 600 CFM. More preferably, the diameter of the vacuum hose 26 is about 3.5". The vacuum hose diameter is linked to the desired vacuumed air speed and flow. Smaller or larger hose diameters may be used in specific applications.

The length of the vacuum hose 26 may be about 12'.

The length of the nozzle of the vacuum hose 26 may be from about 4' to about 5'.

According to another embodiment, the apparatus 10 may include an hydrostatic hydraulic motor 18 mounted on the main frame 16, a variable flow hydraulic hydrostatic pump 32, an hydraulic gear pump 36 operatively connected to the variable flow hydraulic hydrostatic pump 32, an hydraulic gear pump (not shown, used for accessories of the apparatus 10), a filter (not shown) and a centrifugal suction pump or a blower 24 (i.e., such as a regenerative blower which provides an important amount of power vs. its dimensions). All those components (except the motor) may be described as a single unit called the hydrostatic transmission.

According to another embodiment, the container 28 may be a cyclone container.

Figure 14:
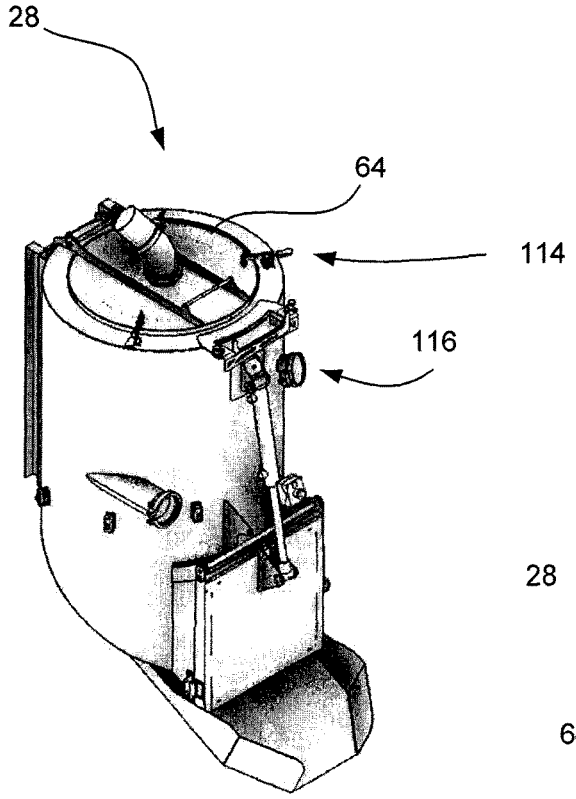
FIG. 14 is a top perspective view of the container of the aero-excavation apparatus of FIG. 1A, where the container lid is in its closed position.
Figure 15:
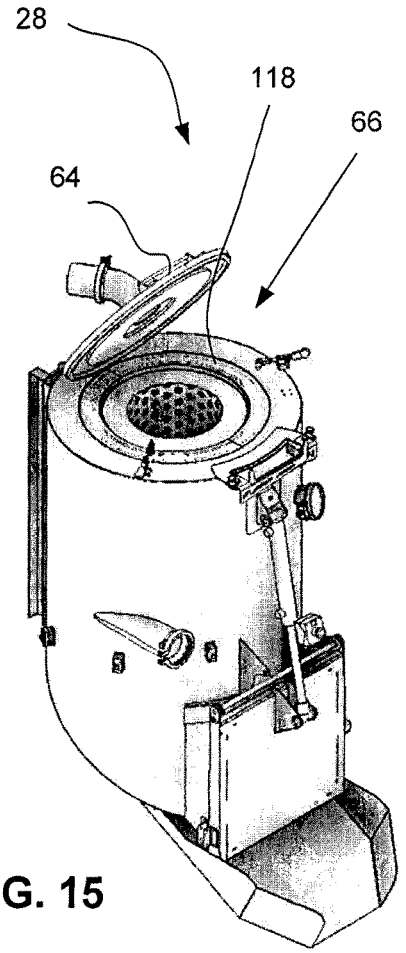
FIG. 15 is a top perspective view of the container of the aero-excavation apparatus of FIG. 1A, where the container lid is in its opened position.

Referring now to FIGS. 14 and 15, there is described in more details the top portion of the container 28. The container 28 further includes a pressurized locking mechanism 114 for sealably locking the container lid 64 to the tank 58. The container 28 further includes a sealable joint 116 for connecting the vacuum hose 26 to the container 28 which may be attached with bolts, or the like, on the tank 58, and a hose adaptor for receiving the end of the vacuum hose 26. The container 28 may further include a lid hinge 118 for sealably connecting the container lid 64 to the tank 58.

Figure 16:
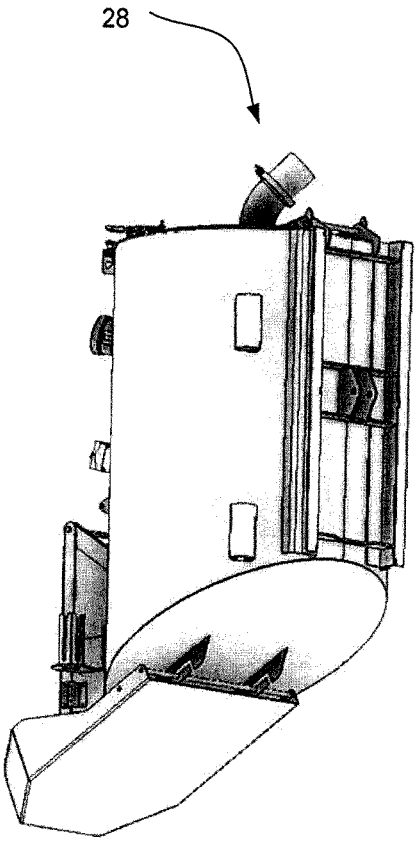
FIG. 16 is a bottom perspective view of the container of the aero-excavation apparatus of FIG. 1A.

Referring now to FIG. 16, there is shown in more details the bottom portion of the container 28 with the container trap 42 being in its closed position.

According to another embodiment, the edge of the nozzle of the vacuum hose 26 may have teeth (not shown) for increasing the removal of the fractured soil material.

It is to be noted that, for avoiding accumulation of the collected fractured soil material within the vacuum hose 26, and therefore a pressure reduction within the vacuum hose 26, the diameter at the nozzle of the vacuum hose 26 may be less than the diameter at the end of the vacuum hose 26.

According to another embodiment, it is to be noted that a blower 24, operably connected to a motor 34, may be both mounted on a main frame 16. However, the blower 24 and corresponding motor 18 may be in driving engagement with a vehicle (not shown) such as a tractor, a lift and the like, which already include a motor 18 and a traction and direction system 20, 22. Thus, the apparatus 10 would not need to include the transmission 30, the motor 18, the hydraulic pumps 32, 36 and the like to operate as it will be dependent of the vehicle. The apparatus 10 according to such an embodiment would include a control board, a container 28, and a hydraulic motor 34 in driving engagement with the blower 24 (regenerative blower). As per example, the main frame 16 may be removably attached to a front portion of such a vehicle.

According to another embodiment, the apparatus 10 may further include a remote control (not shown) for operating the main frame 16 and/or the blower at a specific distance. For example, the control board of the apparatus 10 may include hydraulic control electrically coupled with solenoid(s) and operatively connected to a remote control.

Figure 21:
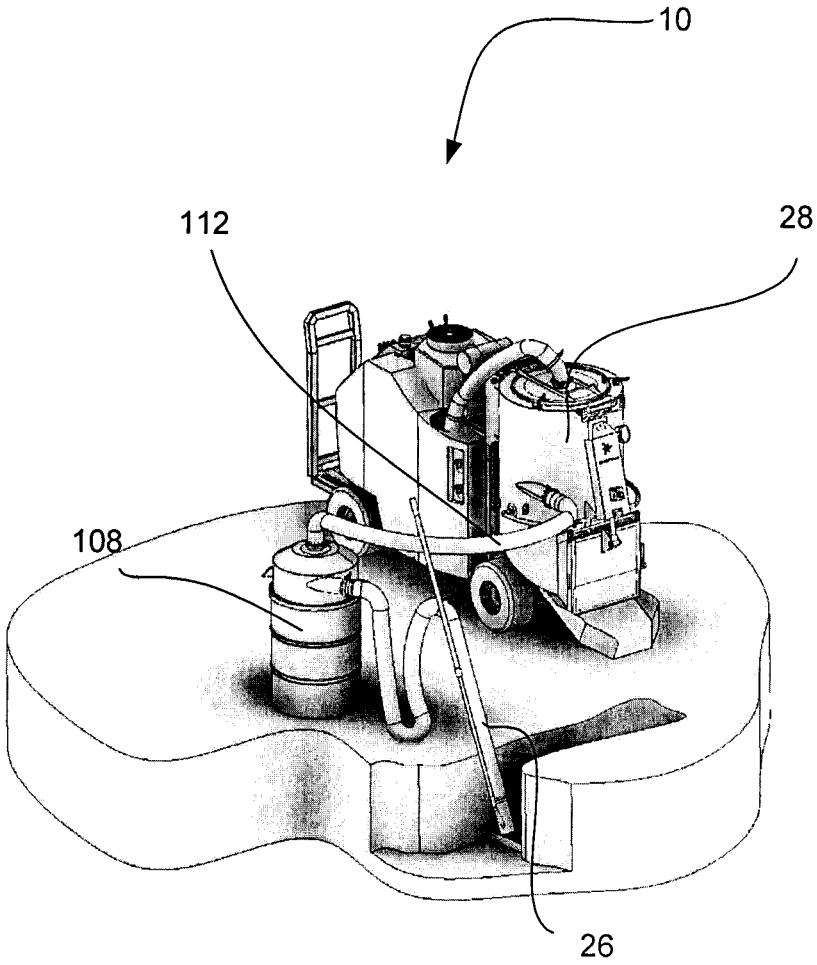
FIG. 21 is a perspective view of an aero-excavation apparatus in its environment, in accordance with another embodiment.

According to another embodiment and referring now to FIG. 21, the apparatus 10 includes a first container 28 that is mounted on the main frame 16 and a second container 108 which is about the main frame 16. The second container 108 is fluidly connected to the first container 28 and the vacuum hose 26 for collecting/receiving the fractured soil material. The first container 28 is in fluid communication with the blower 24. The second container 108 may be used in an environment where the fractured soil material to be collected is difficult to reach when driving and operating the main frame 16. According to this embodiment, the container 28 does not need to include a filter, such as the one described above, as it will use the filter of first container 28.

According to its configuration, the apparatus 10 may provide an important vacuum power via its blower 24 (using a substantially low air flow but an important vacuum strength). This allow for vacuuming small particles in a large quantity. Thus, the apparatus 10 as described above may provide vacuuming of the fractured soil material without needs of displacing large amounts of air.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An aero-excavation apparatus for collecting a fractured soil material using a vacuum hose, the apparatus comprising:

a main frame;

a motor mounted on the main frame;

a traction and direction system in driving arrangement with the motor for driving and operating the main frame;

a vacuum generating regenerative blower in driving engagement with the motor; and a transmission operatively coupled to and between the motor and the vacuum generating regenerative blower, the transmission comprising another motor in driving arrangement with the vacuum generating regenerative blower wherein the vacuum generating regenerative blower is in fluid communication with the vacuum hose for collecting the fractured soil material.

2. The apparatus of claim 1, further comprising a container which is either mounted on or about the main frame, and is fluidly connected to the vacuum generating regenerative blower and the vacuum hose for receiving the fractured soil material.

3. The apparatus of claim 2, further comprising a lifting mechanism mounted on the main frame when the container is mounted on the main frame, the lifting mechanism being in driving arrangement with the motor for displacing the container relative to the main frame between a first position and a second position.

4. The apparatus of claim 2, wherein the container comprises a container opening, the apparatus further comprising a container trap for closing the container opening, the container trap being in driving arrangement with the motor for allowing the container trap to move between a closed position and an opened position.

5. The apparatus of claim 4, wherein the container trap comprises:

a main section having an edge for covering the container opening; and a hinge mounted on an exterior wall of the container for pivotably connecting with the edge of the main section.

6. The apparatus of claim 4, further comprising a material removal device mounted on the container wherein the collected fractured soil material exits the container opening when the container trap is in the opened position.

7. The apparatus of claim 6, wherein the material removal device comprises:

a vibration plate defining a concave surface facing an interior peripheral wall of the container; and an elongated hollow member extending from the concave surface, the elongated hollow member defining a first end and a second end, with the first end extending towards to the interior peripheral wall and the second end extending away from the interior peripheral wall; wherein the first end of the elongated hollow member is adapted to receive compressed fluid, thereby providing the compressed fluid first towards the second end of the elongated hollow member and second towards the concave surface in a way to provide the vibration plate to vibrate and provide the compressed fluid to circulate within the collected fractured material contained in the container.

8. The apparatus of claim 6, wherein the material removal device comprises a raking device, the raking device being configured for movement between an extended position for receiving the collected fractured soil material in the container and a retracted position for raking the collected fractured soil material outside the container opening.

9. The apparatus of claim 2, wherein the container comprises:

a tank;

a filter guard container received in the tank;

a filter received in the filter guard container for filtering the collected fractured soil material.

10. The apparatus of claim 1, further comprising a pump for driving the traction and direction system, and wherein the transmission is operatively coupled to and between the motor and the pump.

11. The apparatus of claim 10, further comprising another motor operatively coupled to the transmission and the vacuum generating regenerative blower, whereby the motor drives the pump and the other motor drives the vacuum generating regenerative blower.

12. The apparatus of claim 1, wherein the transmission comprises one of:

a mechanical transmission comprising one of a gear box, a centrifugal clutch and a continuously variable transmission; and a hydraulic transmission.

13. The apparatus of claim 1, further comprising:

a hydraulic pump for driving the traction and direction system, wherein the transmission is operatively coupled to and between the motor and the hydraulic pump; and further wherein the transmission comprises another hydraulic pump operatively coupled to the vacuum generating regenerative blower.

14. The apparatus of claim 1, further comprising the vacuum hose and wherein the vacuum hose comprises a hose section and a nozzle section extending from the hose section.

15. The apparatus of claim 1, further comprising a driving area within the main frame for allowing a driver to drive and operate the main frame.

16. The apparatus of claim 1, further comprising a control system for controlling at least one of: the motor, the traction and direction system and the vacuum generating regenerative blower.

17. The apparatus of claim 1, wherein a first container is mounted on the main frame and further wherein a second container is about the main frame, the second container being fluidly connected to the vacuum generating regenerative blower and the vacuum hose for receiving the fractured soil material.

18. The apparatus of claim 1, wherein the transmission comprises a mechanical transmission.

19. An aero-excavation apparatus for collecting a fractured soil material, the apparatus comprising:

a main frame;

a motor mounted on the main frame;

a traction and direction system in driving arrangement with the motor for driving and operating the main frame;

a vacuum generating regenerative blower in driving engagement with the motor;

a transmission operatively coupled to the motor and to the vacuum generating regenerative blower, the transmission comprising another motor in driving arrangement with the vacuum generating regenerative blower;

a vacuum hose in fluid communication with the vacuum generating regenerative blower for collecting the fractured soil material; and a container mounted on the main frame fluidly connected to the vacuum generating regenerative blower and the vacuum hose for receiving the fractured soil material.

20. A method for making an excavation in a ground made of soil, the method comprising:

using a fracturing hose connected to a compressor, applying a fluid pressure to the ground to fracture the soil; and while applying the fluid pressure, collecting the fractured soil using a vacuum hose in fluid communication with a vacuum generating regenerative blower driven by a motor which is separate and distinct from the compressor, wherein a transmission is operatively coupled to the motor and the vacuum generating regenerative blower.

* * * * *